US007614979B2

(12) United States Patent
Thomson et al.

(10) Patent No.: US 7,614,979 B2
(45) Date of Patent: Nov. 10, 2009

(54) STATIONARY CHILD EXERCISE APPARATUS

(75) Inventors: John Matthew Thomson, Dahlonega, GA (US); Stephen R. Burns, Cumming, GA (US); Jacob M. Sclare, Dacula, GA (US); James E. Cartabiano, Gainesville, GA (US)

(73) Assignee: Kids II, Inc., Alpharetta, GA (US)

( * ) Notice: Subject to any disclaimer, the term of this patent is extended or adjusted under 35 U.S.C. 154(b) by 672 days.

(21) Appl. No.: 11/396,408

(22) Filed: Mar. 31, 2006

(65) Prior Publication Data

US 2006/0237944 A1 Oct. 26, 2006

Related U.S. Application Data

(60) Provisional application No. 60/666,888, filed on Apr. 1, 2005.

(51) Int. Cl.
*A63B 22/00* (2006.01)
*A63G 9/00* (2006.01)

(52) U.S. Cl. ..... 482/69; 472/118

(58) Field of Classification Search ..... 482/27–29, 482/66–69, 121; 472/118; 135/67, 71, 84
See application file for complete search history.

(56) References Cited

U.S. PATENT DOCUMENTS 16,150 A * 12/1856 Robbins ..... 280/87.051
3,532,356 A * 10/1970 Lillibridge ..... 280/87.051
4,551,108 A * 11/1985 Bass ..... 482/69
4,941,497 A * 7/1990 Prather et al. ..... 135/67
5,221,241 A * 6/1993 Bare, II ..... 482/43
5,526,893 A * 6/1996 Higer ..... 180/65.1
5,690,383 A 11/1997 Meeker
5,788,606 A * 8/1998 Rich ..... 482/27
5,857,944 A * 1/1999 Cone et al. ..... 482/66
6,135,922 A * 10/2000 Nissen ..... 482/27
6,425,842 B1 7/2002 Stern et al.
6,682,139 B2 1/2004 Bellows et al.
6,742,523 B2 * 6/2004 Dubats ..... 128/875
6,854,799 B1 2/2005 Asbach et al.
6,896,575 B2 5/2005 Fair et al.
6,932,709 B1 * 8/2005 Gubitosi et al. ..... 472/118
6,994,630 B2 * 2/2006 Paesang ..... 472/118

* cited by examiner

*Primary Examiner*—Fenn C Mathew
(74) *Attorney, Agent, or Firm*—Alston & Bird LLP

(57) ABSTRACT

Various embodiments of the invention are directed to a stationary exercise apparatus for providing exercise functionality for small children that includes first and second upper frame members and first and second base frame members that are coupled to first and second stationary hubs, an activity table, a seat, and one or more resilient members that suspend the activity table and seat between the upper frame members. The upper frame members extend upwardly and in a radially outward direction from the stationary hubs, and the base frame members extend downwardly and in a radially outward direction from the stationary hubs to engage a support surface. The one or more resilient members have a resiliency that allows a child within the apparatus to bounce vertically relative to the support surface in response to the child pushing its legs against the support surface.

27 Claims, 29 Drawing Sheets

STATIONARY CHILD EXERCISE APPARATUS

CROSS-REFERENCE TO RELATED APPLICATIONS

This application claims priority from provisional U.S. Application No. 60/666,888 entitled "Stationary Jumper," which was filed on Apr. 1, 2005 and is herein incorporated by reference.

BACKGROUND OF THE INVENTION

Stationary exercise apparatuses are used to assist children in the development of the muscles and coordination needed for walking. A typical stationary child exercise apparatus includes a seat portion that is positioned in the center of the apparatus. In some embodiments, the seat is supported by one or more legs that extend downwardly from the seat to the support surface and is configured to bounce vertically between the one or more legs (e.g., U.S. Pat. No. 6,299,247). In other embodiments, a resilient support surface extends between the legs of the apparatus and is positioned below the seat such that a child positioned within the apparatus can push against the resilient support surface to achieve a bouncing effect (e.g., U.S. Published Patent Application No. 2005/0264088). And, in other embodiments, the apparatus includes a base that has legs extending vertically upwardly from the base, and the seat is suspended by resilient members, such as bungee cords, that extend from the legs to the seat, enabling the child to jump on the floor while being suspended in the seat (e.g., U.S. Pat. No. 5,690,383).

For example, U.S. Pat. No. 6,832,709 is directed to a jumper that includes first and second A-shaped frame portions, each having a first leg, a second leg, and an apex, and a ground engaging portion coupling the first frame portion and the second frame portion. The jumper further includes first and second resilient members, and each resilient member includes a first end that is coupled to at least one of the first leg or the second leg of each A-shaped frame portion and an opposite, second end that is coupled to a seat. The seat is suspended by the resilient members between the A-shaped frame portions. The ground engaging portion occupies a relatively large footprint to provide stability for the A-shaped frame portions, and the height of the A-shaped frame portions makes it difficult to access a child within the jumper at every angle around the jumper.

Thus, there remains a need in the art for an exercise apparatus that occupies less floor space while providing a sufficient amount of support for and access to a child seated within the apparatus. In addition, there remains a need for an exercise apparatus that is collapsible to facilitate storage or portability.

BRIEF SUMMARY OF THE INVENTION

Various embodiments of the invention are directed to a stationary exercise apparatus for providing exercise functionality for small children. In one embodiment, the apparatus includes one or more upper frame members and one or more base frame members that are coupled to one or more stationary hubs, an activity table, a seat, and one or more resilient members that suspend the activity table and seat between the one or more upper frame members. In particular, according to one embodiment, the one or more upper frame members extend upwardly and in a radially outward direction from the one or more stationary hubs, and the one or more base frame members extend downwardly and in a radially outward direction from the one or more stationary hubs to engage the support surface.

The seat is structured to support a child while allowing the child's legs to extend downwardly below the seat, and the activity table at least partially surrounds the seat and is adapted for receiving one or more children's activity items. The seat and activity table are suspended from the one or more upper frame members by one or more resilient members that extend between the one or more upper frame members and the seat and activity table. The one or more resilient members have a resiliency that is adapted for suspending the activity table and seat above the support surface and allowing the child to bounce vertically relative to the support surface in response to a substantially vertical push, such as by using the child's legs to push against the support surface.

In one embodiment, the one or more upper frame members and the one or more base frame members are pivotably coupled to the one or more stationary hubs, allowing each frame member to pivot about the stationary hub from an extended position to a folded position. Having the ability to collapse the apparatus allows the apparatus to occupy less space when not in use or when being stored, for example.

BRIEF DESCRIPTION OF THE DRAWINGS

Reference will now be made to the accompanying drawings, which are not necessarily drawn to scale, and wherein.

DETAILED DESCRIPTION OF THE INVENTION

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Generally, various embodiments of the present invention are directed to a children's stationary exercise apparatus. In various embodiments, the apparatus includes one or more upper frame members, one or more base frame members, one or more stationary hubs coupling the one or more upper frame members and the one or more base frame members, an activity table, a seat, and one or more resilient members suspending the activity table and seat between the one or more upper frame members above a support surface. The one or more upper frame members extend upwardly and in a radially outward direction from the stationary hubs, and the base frame members extend downwardly and in a radially outward direction from the stationary hubs to engage a support surface. According to one embodiment, having one or more upper frame members that extend in an upward and radially outward direction provides several advantages including providing an apparatus that occupies less floor space while continuing to provide sufficient support for and access to a child positioned within the apparatus. In addition, activity items, such as toys and teething rings, may be suspended from the upper frame members and within reach of the child positioned within the apparatus.

The seat is mounted substantially in the center of the activity table and can be configured to rotate 360° about its own axis of rotation. The resilient support members extend between the upper frame members and the seat, such that when a child positioned within the apparatus pushes its legs against the support surface, the child achieves an up and down bouncing motion through the resilient members. This bouncing motion assists in the development of the muscles and coordination needed for standing and walking. Furthermore, in one embodiment, the seat is at least partially surrounded by an activity table that provides activity items, including toys, teething toys, and interactive learning modules.

Figure 1:
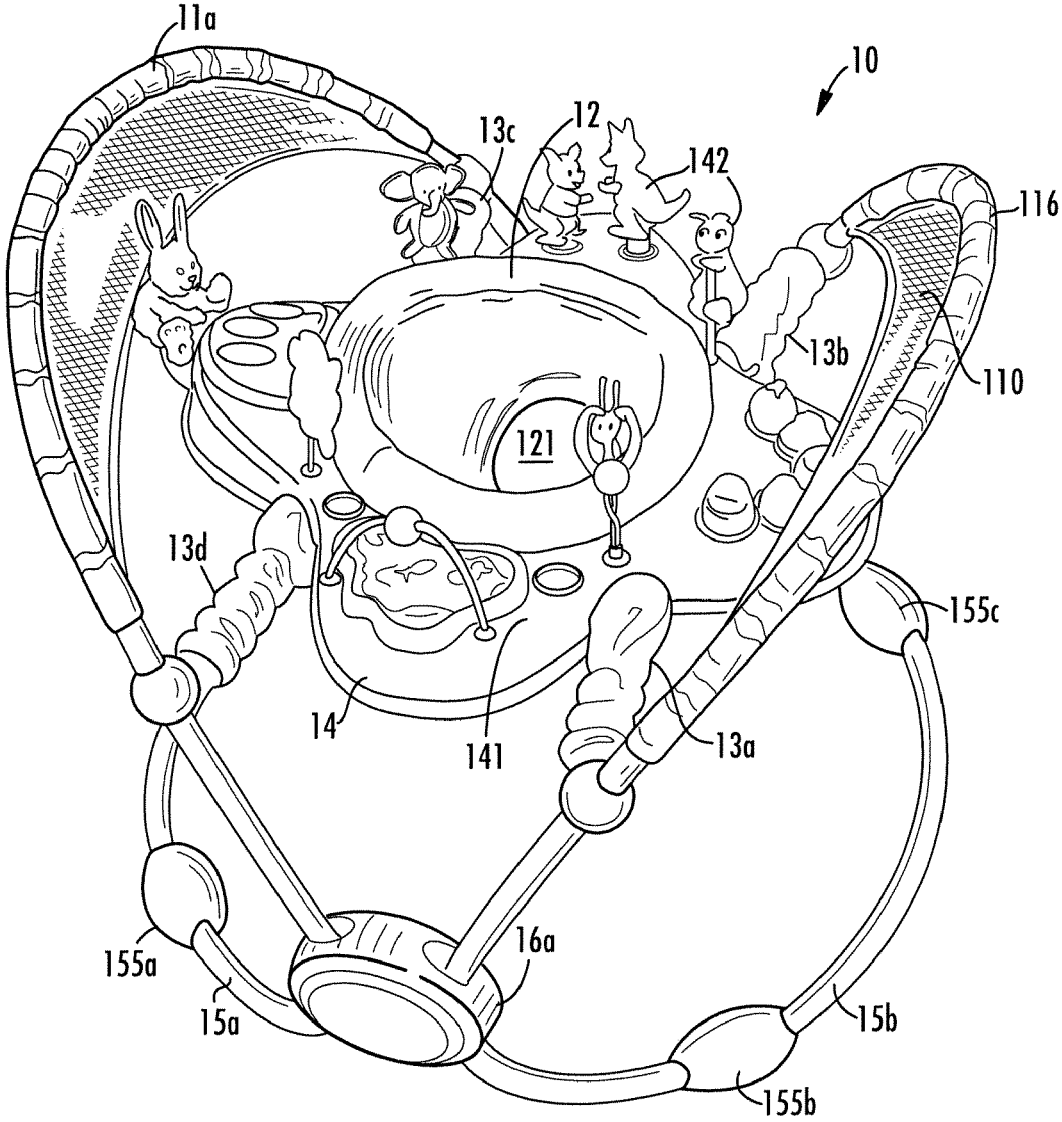
FIG. 1 shows a perspective view of a stationary child exercise apparatus according to one embodiment of the invention.
Figure 2:
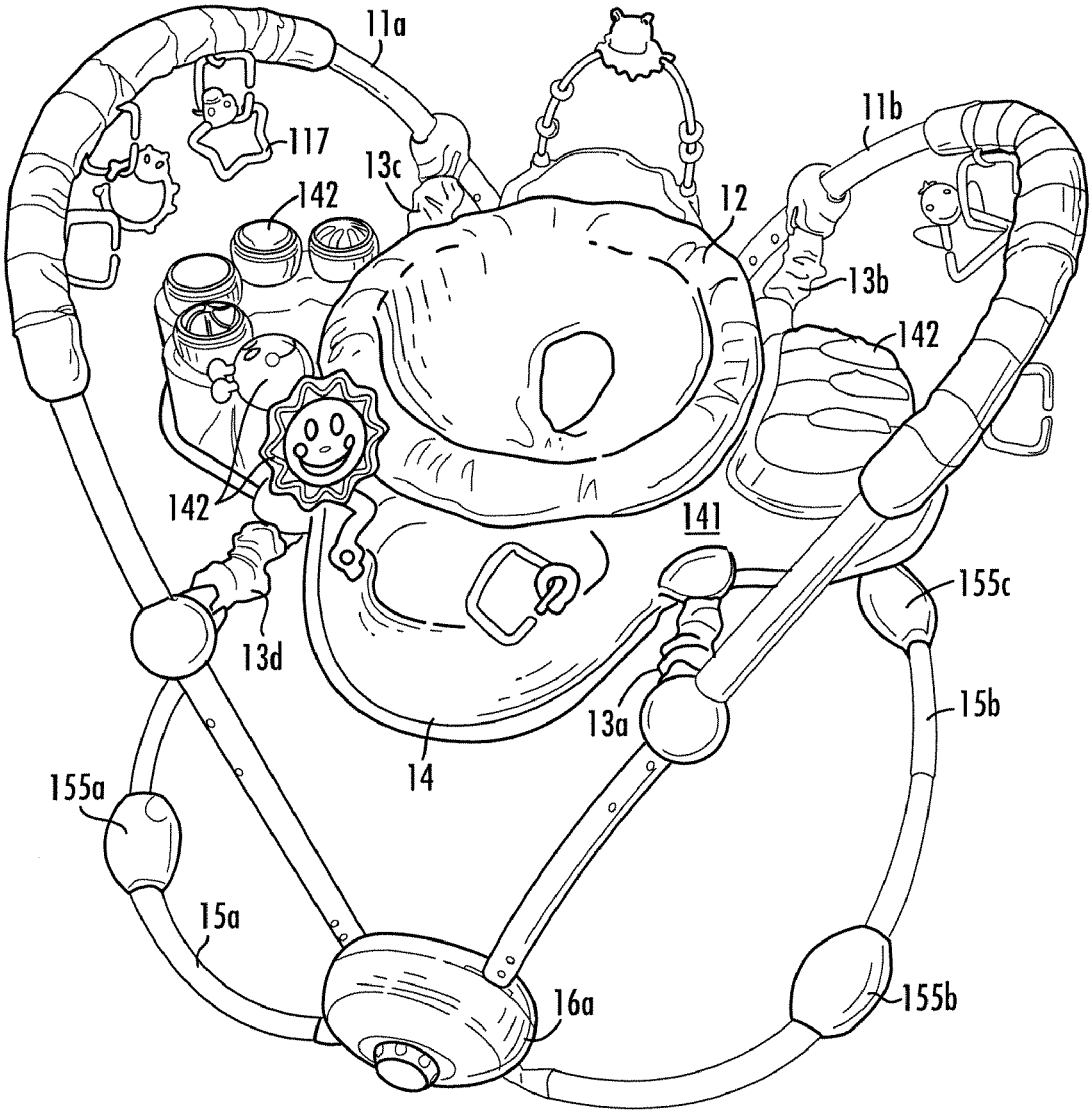
FIG. 2 shows a perspective view of a stationary child exercise apparatus according to another embodiment of the invention.

As shown in FIGS. 1 and 2, various embodiments of the invention are directed to a children's exercise apparatus 10 for providing exercise functionality for a small child. The apparatus 10 includes first 16*a* and second stationary hubs 16*b*, first 11*a* and second upper frame members 11*b* extending upwardly and radially outwardly from the stationary hubs 16*a*, 16*b*, first 15*a* and second base members 15*b* extending downwardly and radially outwardly from the stationary hubs 16*a*, 16*b*, a seat 12 structured to support the child while allowing the child's legs to extend downwardly below the seat 12, and one or more resilient members 13*a-d* that extend between the upper frame members 11*a*, 11*b* and the seat 12 and suspend the seat 12 between the upper frame members 11*a*, 11*b* above the support surface. The upper frame members 11*a*, 11*b* are arcuate-shaped and are coupled to each of the stationary hubs 16*a*, 16*b* such that the upper frame members 11*a*, 11*b* splay in a radially outward direction from the stationary hubs 16*a*, 16*b*. According to some embodiments, the splayed upper frame members 11*a*, 11*b* provide 360° access to the child positioned within the apparatus 10. The resilient members 13*a-d* have a resiliency adapted for allowing the child to bounce vertically by pushing its legs downwardly against the support surface. In addition, in one embodiment, the seat 12 defines a pair of leg openings 121 that allow the child to touch the support surface 13 with its legs. A further embodiment of the apparatus 10 includes an activity table 14 that includes an upper surface 141 for supporting activity items 142, such as toys, teething rings, and interactive learning modules. In addition, as described below in relation to FIGS. 17 and 19-27, the upper frame members 11*a*, 11*b* and the base frame members 15*a*, 15*b* are pivotably coupled to stationary hubs 16*a*, 16*b*, allowing the upper frame members 11*a*, 11*b* and base frame members 15*a*, 15*b* to fold upwardly relative to the stationary hubs 16*a*, 16*b* from an extended position to a folded position.

Figure 3:
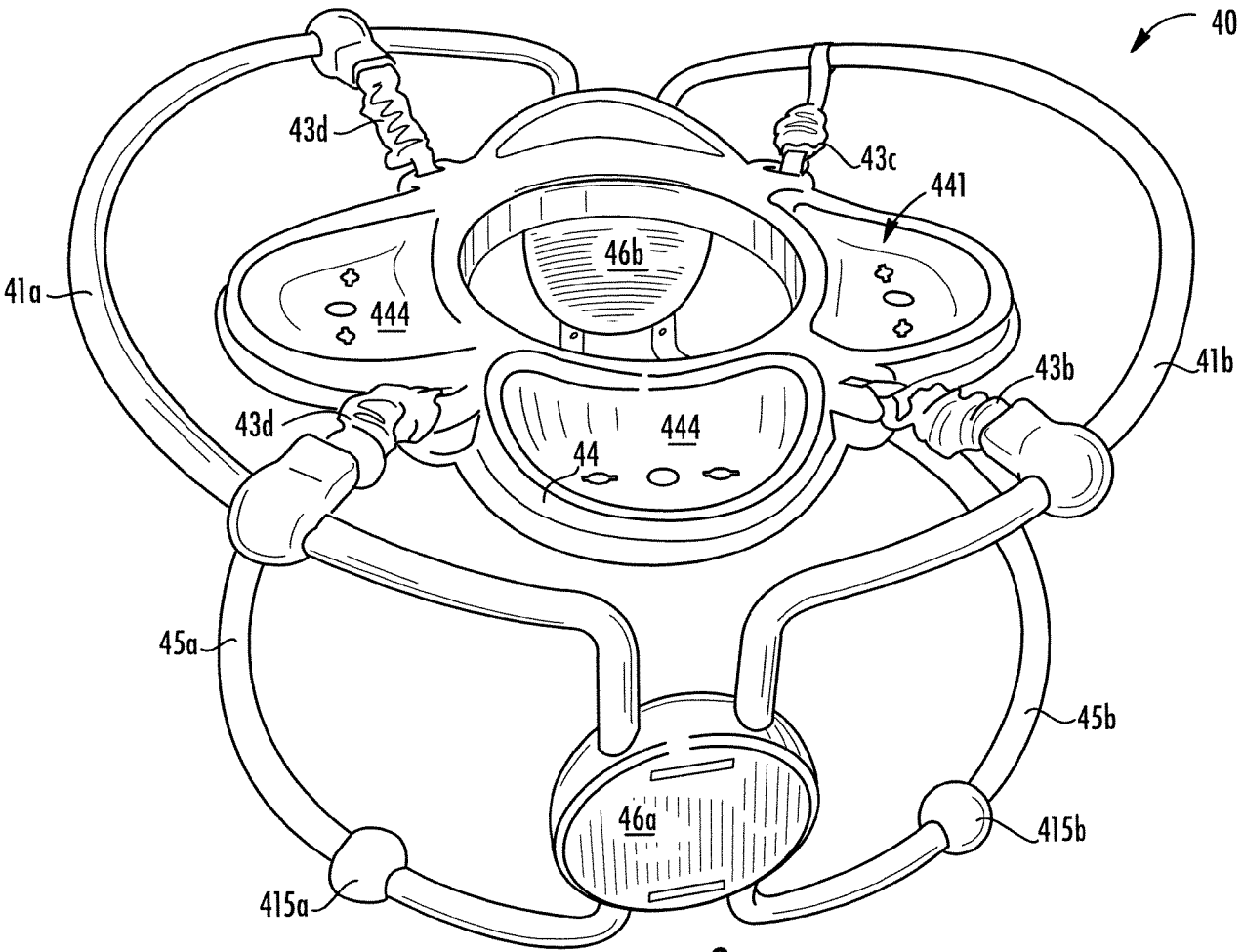
FIG. 3 shows a perspective view of a stationary child exercise apparatus according to another embodiment of the invention.

FIG. 3 shows an alternative embodiment of the invention in which each of the first and second upper frame members 41*a*, 41*b* includes a generally horizontal portion, a generally vertical portion, and a bend that extends between the horizontal portion and the vertical portion. Each vertical portion extends upwardly from the stationary hubs 46*a*, 46*b*, and each horizontal portion extends in a radially outward direction from the bend. In one embodiment, the horizontal portion of the upper frame members 41*a*, 41*b* is generally arcuate shaped.

The various embodiments of the elements of apparatus 10, 20 are discussed in more detail below. However, these embodiments are exemplary and should not limit the scope of the invention, and one or more features from one embodiment could be combined with features from other embodiments.

Frame Members

As discussed above, first and second upper frame members 11*a*, 11*b* extend upwardly and in a radially outward direction from the first and second stationary hubs 16*a*, 16*b*, and the first and second base frame members 15*a*, 15*b* extend downwardly in a radially outward direction from the stationary hubs 16*a*, 16*b*. According to the embodiments shown in FIGS. 1, 2, 15, and 20, the upper frame members 11*a*, 11*b* and the base frame members 15*a*, 15*b* have a tubular shape and may be formed from metal or plastic, for example. Each upper frame member 11*a*, 11*b* and base frame member 15*a*, 15*b* further includes a middle portion 111, 151 and two end portions 112*a*, 112*b*, 152*a*, 152*b*. The end portions 112*a*, 112*b*, 152*a*, 152*b* are coupled adjacent the stationary hubs 16*a*, 16*b*, and the middle portions 111, 151 are generally arcuate shaped and extend between the two end portions 112*a*, 112*b*, 152*a*, 152*b*, as shown in FIGS. 1-2, 15-16, and 18.

Figure 15:
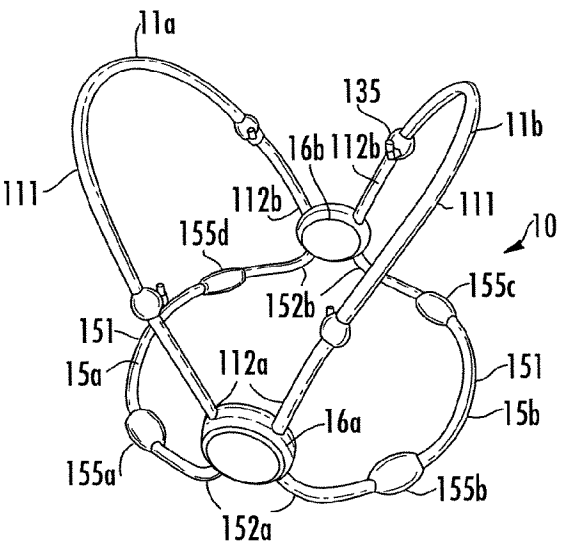
FIG. 15 shows a perspective view of a frame structure of a stationary child exercise apparatus according to one embodiment of the invention.
Figure 17:
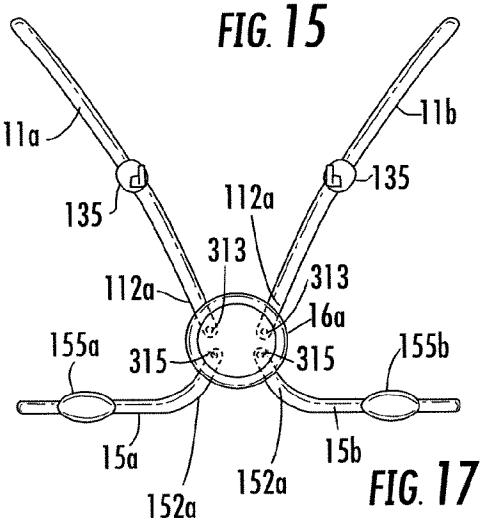
FIG. 17 shows a first side view of the frame structure in FIG. 15.
Figure 19:
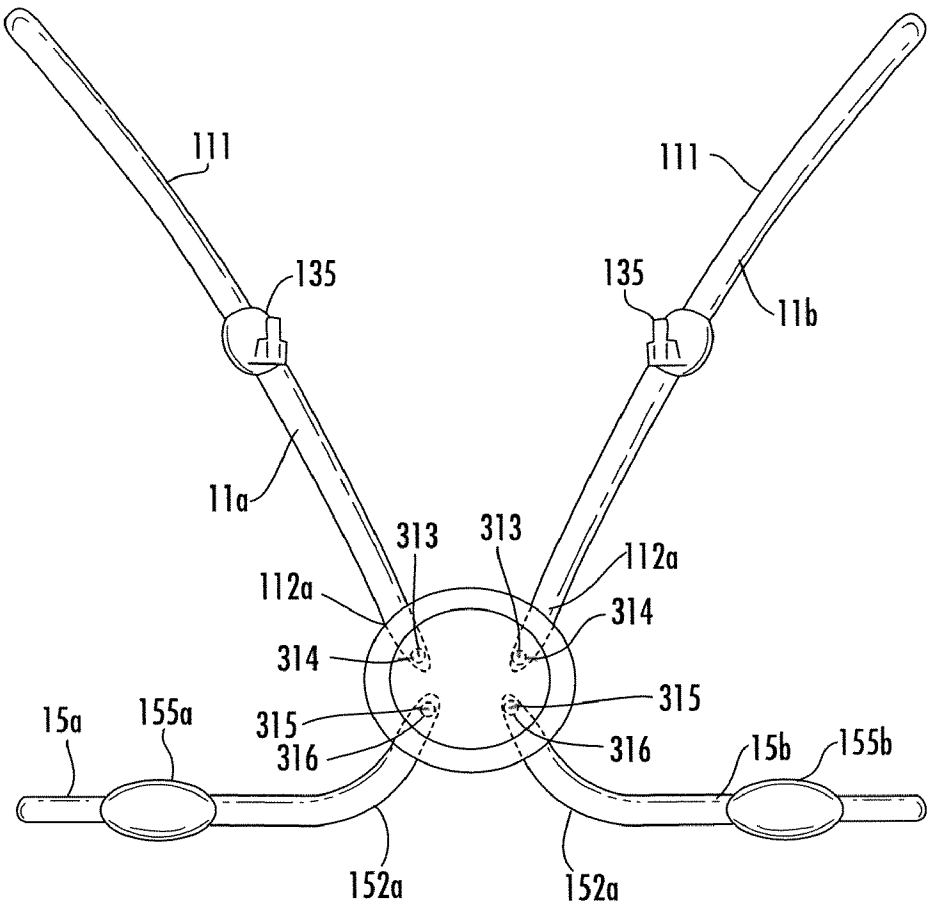
FIG. 19 shows cross-sectional view of a stationary hub according to one embodiment of the invention.

According to the embodiments shown in FIGS. 1 and 2, the end portions 112*a*, 112*b* and the middle portion 111 of the upper frame members 11*a*, 11*b* extend in an upward and radially outward direction from each stationary hub 16*a*, 16*b*. As shown in FIGS. 15, 17, and 19, the end portions 112*a*, 112*b* and the middle portion 111 of the upper frame members 11*a*, 11*b* converge toward each stationary hub 16*a*, 16*b* (e.g., forming a V-shape). In addition, as shown in FIGS. 15-18, the middle portion 151 of each base frame member 15*a*, 15*b* lies substantially in a plane that is substantially parallel with the support surface, and the end portions 152*a*, 152*b* of each base frame member 15*a*, 15*b* extend downwardly from the stationary hubs 16*a*, 16*b* toward the middle portion 151. As shown in FIGS. 15, 17, and 19, the end portions 112*a*, 112*b*, 152*a*, 152*b* of the upper frame members 11*a*, 11*b* and the base frame members 15*a*, 15*b* form an X-shape with respect to each stationary hub 16*a*, 16*b*.

Figure 21:
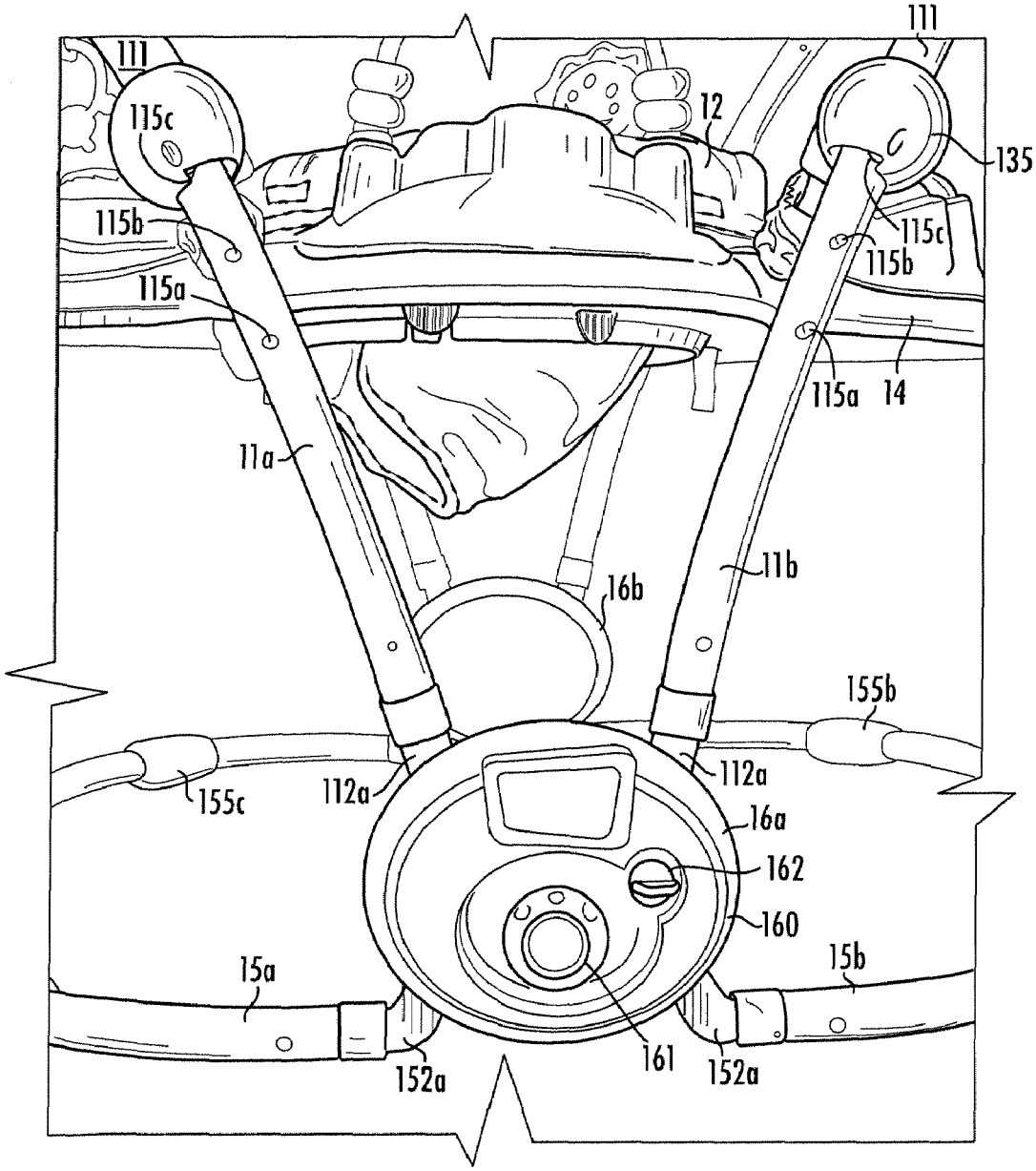
FIG. 21 shows a perspective view of a stationary child exercise apparatus in an expanded position according to one embodiment of the invention.
Figure 22:
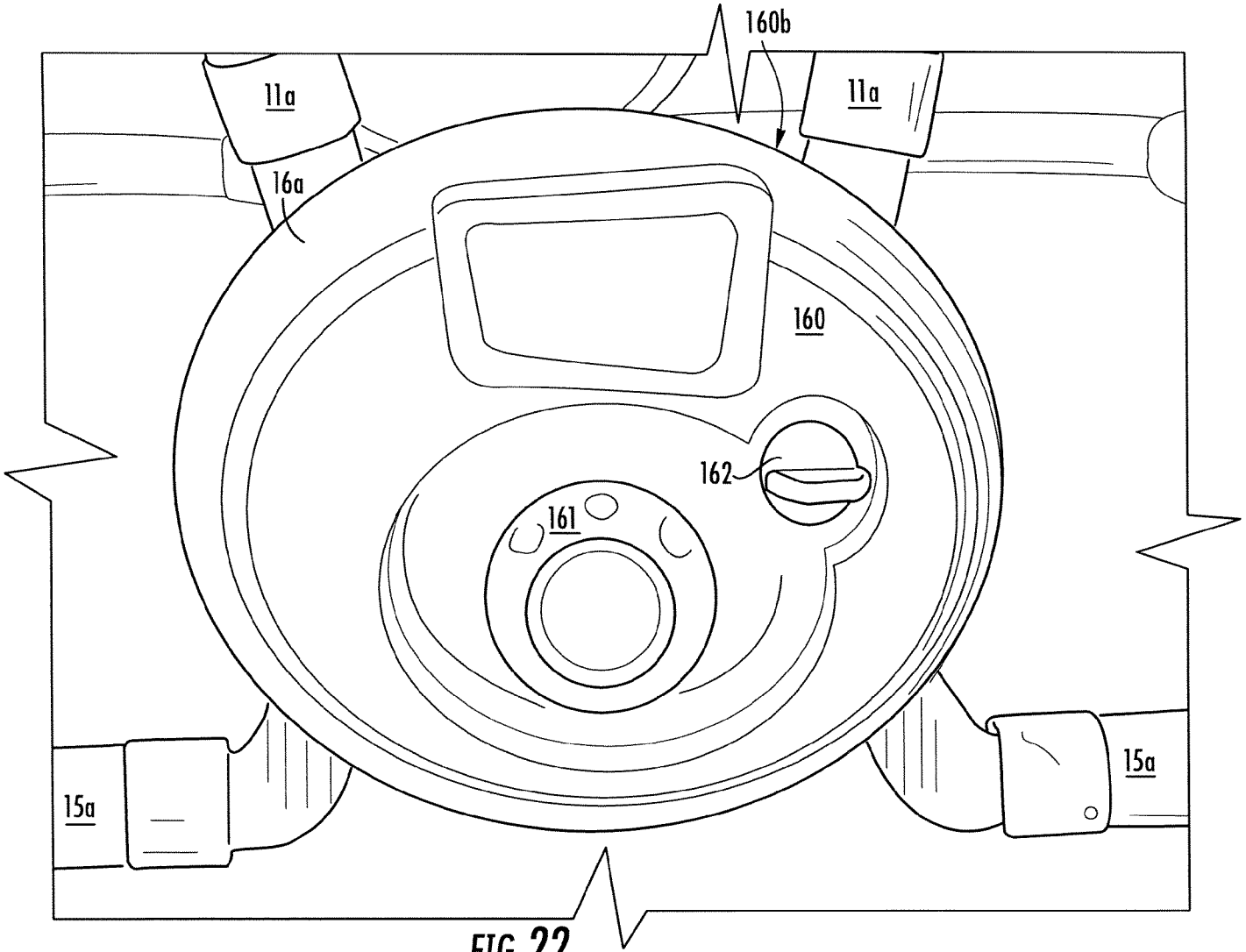
FIG. 22 shows a stationary hub according to one embodiment of the invention.

In addition, according to one embodiment shown in FIG. 21, the end portions 112*a*, 112*b*, 152*a*, 152*b* taper from being substantially tubular to substantially flat. Furthermore, in one embodiment, the middle portion 111, 151 and end portions 112*a*, 112*b*, 152*a*, 152*b* of the upper frame members 11*a*, 11*b* and base frame members 15*a*, 15*b*, respectively, are formed separately and are adapted to engage each other (e.g., using fasteners or a snap fit). In another embodiment, the middle portion 111, 151 and the end portions 112*a*, 112*b*, 152*a*, 152*b* are integrally formed together.

According to the embodiments shown in FIGS. 1-2 and 15-19, the base frame members 15*a*, 15*b* further include stability members 155*a-d* that are adapted to engage the support surface and prevent the base frame members 15*a*, 15*b* from slipping on the support surface. The stability members 155*a-d* may further serve as a shock absorber for the base frame members 15*a*, 15*b*, according to one embodiment of the invention. In addition, in various embodiments, the stability members 155*a-d* are formed of a plastic material and define an aperture therethrough that is adapted for receiving the base frame member 15*a*, 15*b*. In addition, in the embodiment shown in FIG. 28, the stability members 155*a-d* further include non-slip material 156 on a lower surface of the stability members 155*a-d* that is adapted for further preventing the apparatus 10 from slipping on the support surface.

The upper frame members 11*a*, 11*b* in the embodiments shown in FIGS. 1 and 2 further include protrusions 115*a-c* that are adapted for engaging a portion of a resilient member connector 135 to allow the user to adjust the height of the seat 12 relative to the support surface. The protrusions 115*a-c* extend from the middle portion 111 of the upper frame members 11*a*, 11*b* in a substantially perpendicular direction relative to a plane that is substantially tangent to the upper frame members 11*a*, 11*b*. In addition, the protrusions 115*a-c* are positioned below an apex 116 of the upper frame members 11*a*, 11*b*. Embodiments of the resilient member connector 135 and the protrusions 115*a-c* are discussed in more detail below in relation to FIGS. 29-34.

In addition, as mentioned above, various embodiments of the invention allow for activity items, such as toys and teething rings, to be suspended from the upper frame members 11*a*, 11*b*. For example, in the embodiment shown in FIG. 2, activity items 117 are suspended directly from the upper frame members 11*a*, 11*b*. The radially outwardly splayed profile of the upper frame members 11*a*, 11*b* allows the child positioned within the apparatus 10 to interact with the activity items 117 while avoiding injury by the activity items 117 or the upper frame members 11*a*, 11*b* when bouncing within the apparatus 10. In another embodiment, which is shown in FIG. 1, the upper frame members 11*a*, 11*b* further include a piece of resilient fabric material 110 that stretches between the middle portion 111 of each upper frame member 11*a*, 11*b*. According to this embodiment, activity items 117 may be suspended from the resilient fabric material 110 when a child is smaller and removed as the child grows.

In an alternative embodiment shown in FIG. 3, the middle portions 411, 451 of the upper frame members 41*a*, 41*b* and the base frame members 45*a*, 45*b*, respectively, each lie in a plane that is substantially parallel with the support surface. In addition, each end portion 412*a*, 412*b* of each upper frame member 41*a*, 41*b* extends generally upwardly from each stationary hub 46*a*, 46*b* toward a bend, which extends between each middle portion 411 and each end portion 452*a*, 452*b*. The end portions 452*a*, 452*b* of the base frame members 45*a*, 45*b* extend downwardly from the stationary hubs 46*a*, 46*b* toward the middle portion 451 of the base frame members 45*a*, 45*b*, such that the end portions 412*a*, 412*b*, 452*a*, 452*b* converge with respect to the stationary hubs 46*a*, 46*b* (e.g., forming an H-shape). In another alternative embodiment, each upper frame member 41*a*, 41*b* lies within a plane that is at an angle of less than 45° from the plane parallel to the support surface. Furthermore, the upper frame members 41*a*, 41*b* include apertures 415*a-c* that are adapted to receive protrusions (not shown) that extend from resilient member connectors 435, which allows a user to adjust the height of the seat 42 relative to the support surface.

Figure 4:
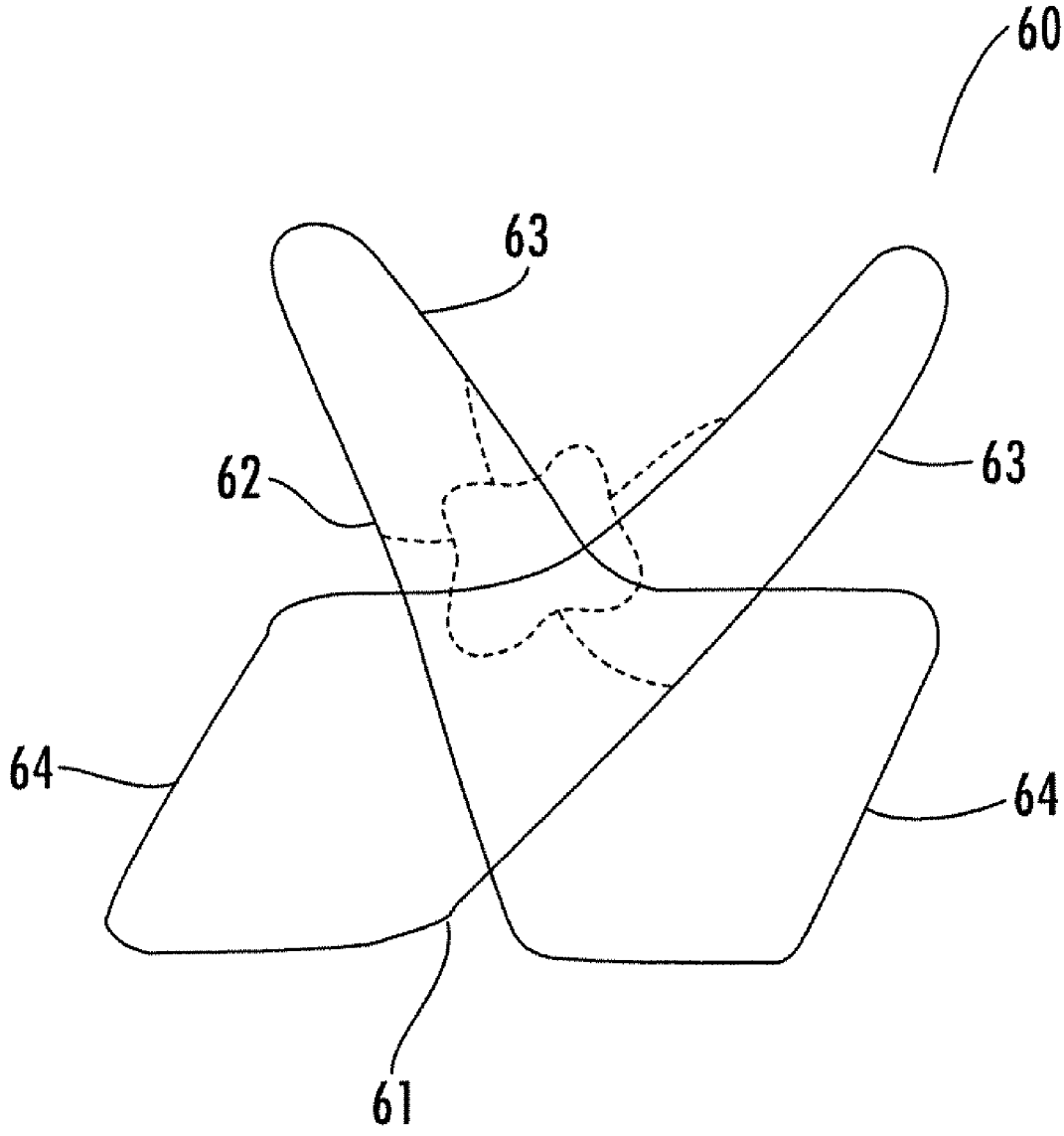
FIG. 4 shows a perspective view of a stationary child exercise apparatus according to another embodiment of the invention.

In another embodiment of the invention, which is shown in FIG. 4, the apparatus 60 includes first 61 and second frame members 62 that each include an upper frame member 63 and a base frame member 64. The base frame members 64 are adapted to engage the support surface. The first 61 and second frame members 62 are pivotably coupled to each other at a position between the upper frame members 63 and the base frame members 64 such that the upper frame members 63 and the base frame members 64 form an X-shape around the position where the first 61 and second frame members 62 are pivotably coupled together. In one embodiment, the upper frame member 63 and the base frame member 64 of the first frame member 61 and the upper frame member 63 and the base frame member 64 of the second frame member 62 are separately formed. In addition, in a further embodiment (not shown), the apparatus 60 may further include one or more stationary hubs 66 that are adapted for receiving an end of the upper frame member 63 of the first frame member 61, an end of the upper frame member 63 of the second frame member 62, an end of the base frame member 64 of the first frame member 61, and an end of the base frame member 64 of the second frame member 62.

Stationary Hubs

As discussed above, the one or more stationary hubs 16*a*, 16*b* couple the upper frame members 11*a*, 11*b* and the base frame members 15*a*, 15*b*. In the embodiments shown in FIGS. 17 and 19-28, the stationary hubs 16*a*, 16*b* further allow the upper frame members 11*a*, 11*b* and the base frame members 15*a*, 15*b* to fold upwardly with respect to the stationary hubs 16*a*, 16*b* from an extended position to a folded position. When the apparatus 10 is in an extended position, such as the embodiments shown in FIGS. 1-2 and 19, 21, and 23-24, the upper frame members 11*a*, 11*b* are splayed in a radially outward direction as described above, the base frame members 15*a*, 15*b* are positioned to engage the support surface, and a child can be positioned within the apparatus 10. When the apparatus 10 is in a folded position, such as the embodiments shown in FIGS. 20 and 28, the upper frame members 11*a*, 11*b* and the base frame members 15*a*, 15*b* are folded upwardly toward each other, allowing the apparatus 10 to be folded to occupy less space for storage or portability, according to various embodiments of the invention. In addition, according to the embodiment shown in FIG. 28, the upper frame members 11*a*, 11*b* fold above the seat 12, and the base frame members 15*a*, 15*b* fold below the seat 12. In a further embodiment (not shown), the seat 12 is configured to rotate about a horizontal axis extending through the seat 12 such that the seat 12 lies in a plane substantially parallel with the frame members 11*a*, 11*b*, 15*a*, 15*b* in their folded positions.

Figure 20:
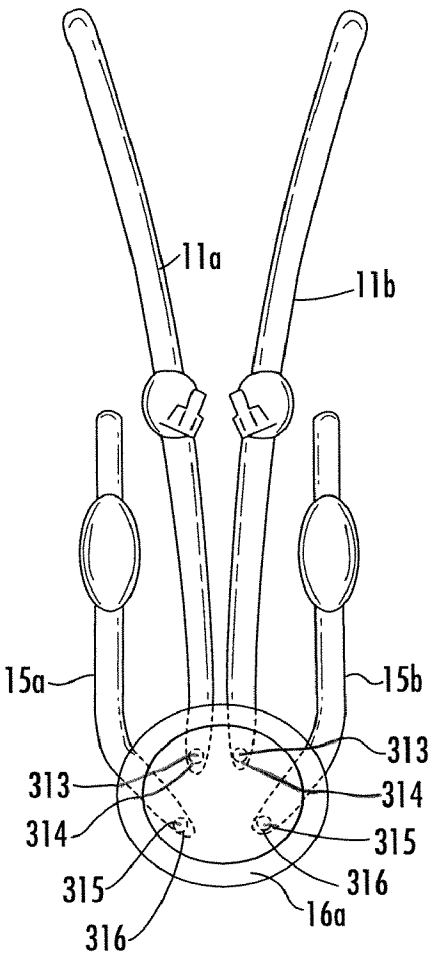
FIG. 20 shows a side view of the stationary child exercise apparatus in a folded position according to one embodiment of the invention.

According to the embodiment shown in FIGS. 17 and 19-20, each end portion 112*a*, 112*b* of each upper frame member 11*a*, 11*b* includes a pivot pin 313 that extends through the end portion 112*a*, 112*b* and is adapted for engaging a pivot slot 314 in each stationary hub 16*a*, 16*b*. Similarly, each end portion 152*a*, 152*b* of each base frame member 15*a*, 15*b* includes a pivot pin 315 that extends through the end portion 152*a*, 152*b* and is adapted for engaging a pivot slot 316 in each stationary hub 16*a*, 16*b*. As discussed in more detail below in relation to the embodiments shown in FIGS. 17 and 19-28, pivotably coupling the frame members 11*a*, 11*b*, 15*a*, 15*b* to the stationary hubs 16*a*, 16*b* allows the frame members 11*a*, 11*b* to move from an extended position to a folded position. Embodiments of the apparatus 10 in an extended position are shown in FIGS. 19, 21, and 23-24, and embodiments of the apparatus 10 in a folded position are shown in FIGS. 20 and 28. In alternative embodiments (not shown), the pivot pins 113, 115 may be positioned in the stationary hub 16*a*, 16*b* and the pivot slots 114, 116 may be positioned in each end portion 112*a*, 112*b*, 152*a*, 152*b*.

According to a particular embodiment shown in FIGS. 21-28, each stationary hub 16*a*, 16*b* includes an outer housing 160 defining a cavity (not shown) and first 191 and second guide plates 192 positioned within the cavity. As shown in the embodiment shown in FIGS. 23-27, the first 191 and second guide plates 192 are spaced apart from each other to receive the end portions 112*a*, 112*b*, 152*a*, 152*b* of each upper frame member 11*a*, 11*b* and base frame member 15*a*, 15*b* between them. The first 191 and second guide plates 192 define a plurality of apertures that are each adapted for receiving a fastener 195 that extends between the plates 191, 192 to maintain their relative position to each other.

Figure 23:
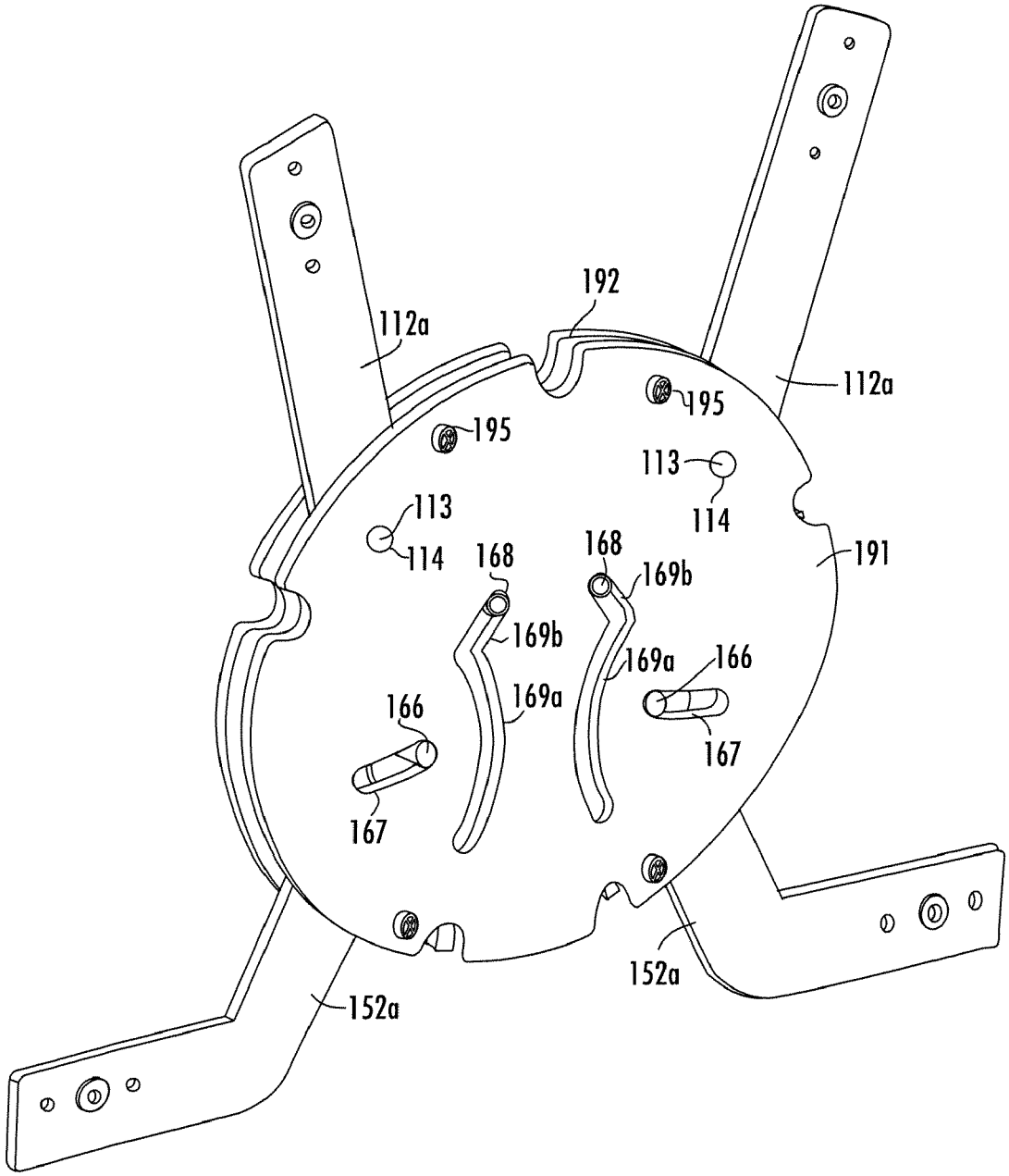
FIG. 23 shows a perspective view of the back of first and second guide plates according to one embodiment of the invention.
Figure 26:
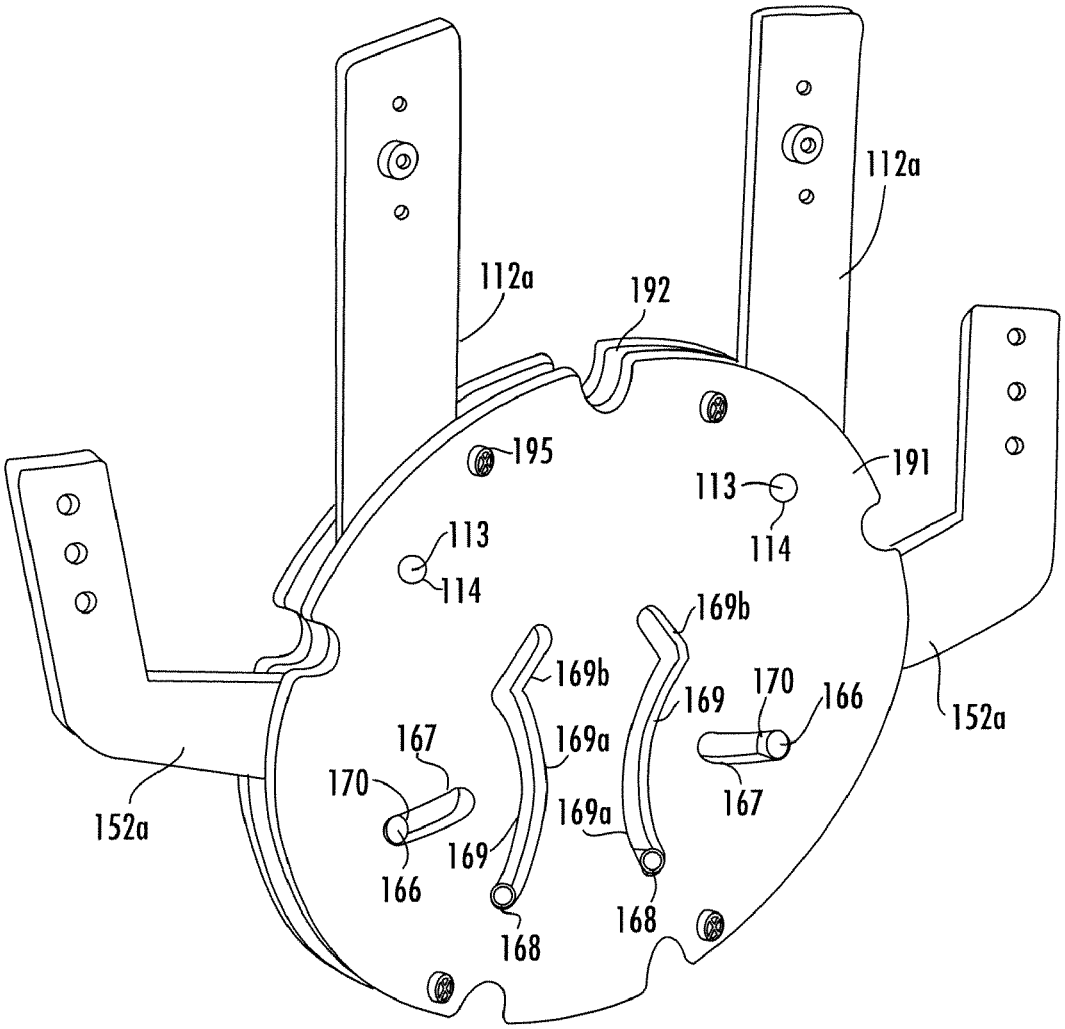
FIG. 26 shows a perspective view of the back of first and second guide plates according to one embodiment of the invention.

As shown in FIGS. 23 and 26, the first 191 and second guide plates 192 further define a pivot slot 114 and first 167 and second guide slots 169 that are each adapted to receive one of a plurality of guide pins extending from the end portions 112*a*, 112*b*, 152*a*, 152*b* of the frame members 11*a*, 11*b*, 15*a*, 15*b*. For example, each end portion 112*a*, 112*b* of each upper frame member 11*a*, 11*b* includes a pivot pin 113 and a first guide pin 166 that are substantially aligned with respect to a substantially vertical axis of each end portion 112*a*, 112*b* of each upper frame member 11*a*, 11*b*. The pivot pin 113 is adapted to engage a first pivot slot 114 defined in the guide plates 191, 192, and the first guide pin 166 is adapted to extend through a second pivot slot 170 defined in the end portion 152*a*, 152*b* of the base frame member 15*a*, 15*b* and engage first guide slot 167 defined in the guide plates 191, 192. The end portion 152*a*, 152*b* of each base frame member 15*a*, 15*b* further includes a second guide pin 168 that is adapted to engage second guide slot 169 defined in the guide plates 191, 192. In one embodiment, the second pivot slot 170 and the second guide pin 168 are substantially aligned along a substantially vertical axis of each end portion 152*a*, 152*b*.

In the embodiment shown in FIGS. 23 and 26, the first guide slot 167 has an arcuate shape with a center defined by pivot slot 114 and extends in a generally horizontal direction with respect to the support surface. The second guide slot 169 includes first 169*a* and second arcuate portions 169*b*, wherein the first arcuate portion 169*a* extends in a generally vertical direction with respect to the support surface and the second arcuate portion 169*b* extends from an upper end of the first arcuate portion 169*a* generally toward a vertical plane extending through the center of the guide plates 191, 192. In addition, according to one embodiment, the first arcuate shaped portion 169*a* of second guide slot 169 has a first radius of curvature, and the second arcuate shaped portion 169*b* has a second radius of curvature that is different from the first radius of curvature. When each base frame member 15*a*, 15*b* is moved downwardly relative to each stationary hub 16*a*, 16*b*, the second guide pin 168 is moved upwardly through the first arcuate shaped portion 169*a* and the second arcuate shaped portion 169*b* of second guide slot 169 and the first guide pin 166 is moved through first guide slot 167 toward the center of the stationary hub 16*a*, 16*b*, which moves the upper frame members 11*a*, 11*b* and base frame members 15*a*, 15*b* into the expanded position. To move the frame members 11*a*, 11*b*, 15*a*, 15*b* into the folded position, each base frame member 15*a*, 15*b* is moved upwardly relative to each stationary hub 16*a*, 16*b*, which moves the second guide pin 168 downwardly through the second arcuate shaped portion 169*b* and the first arcuate shaped portion 169*a* of second guide slot 169 and the first guide pin 166 through first guide slot 167 away from the center of the stationary hub 16*a*, 16*b*.

Figure 24:
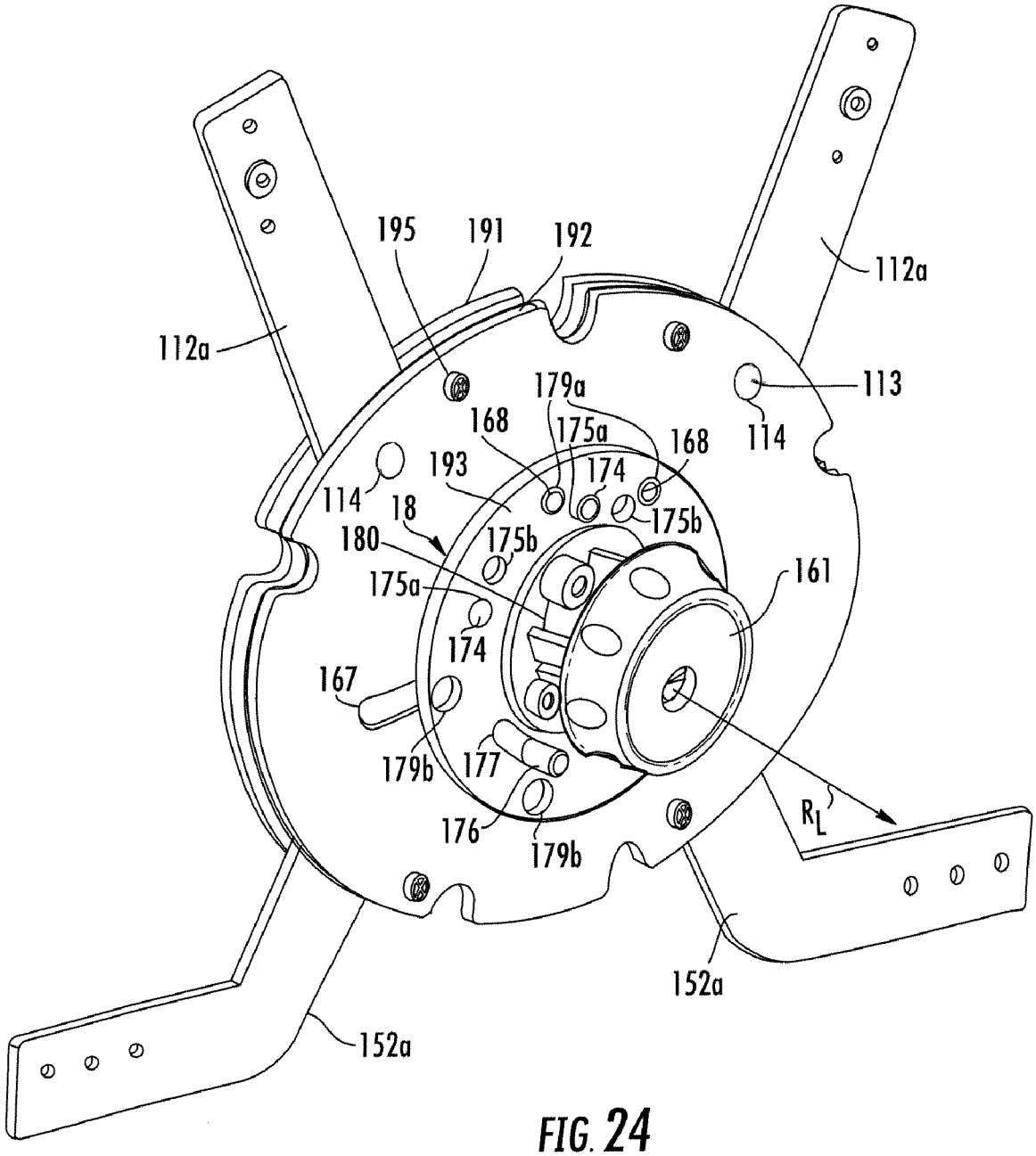
FIG. 24 shows a perspective view of the front of the first and second guide plates shown in FIG. 23.
Figure 25:
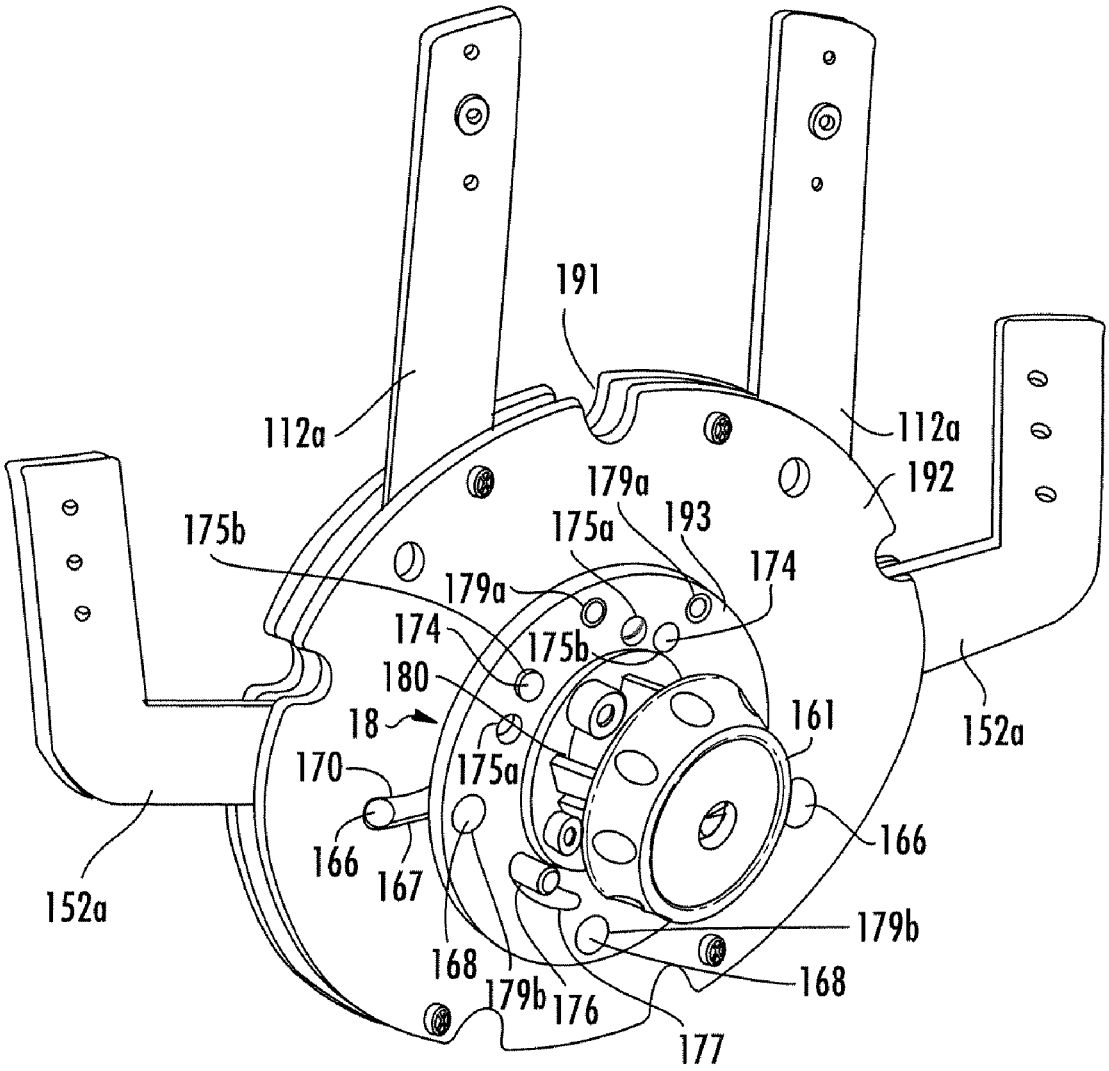
FIG. 25 shows a perspective view of the front of the first and second guide plates shown in FIG. 23.
Figure 27:
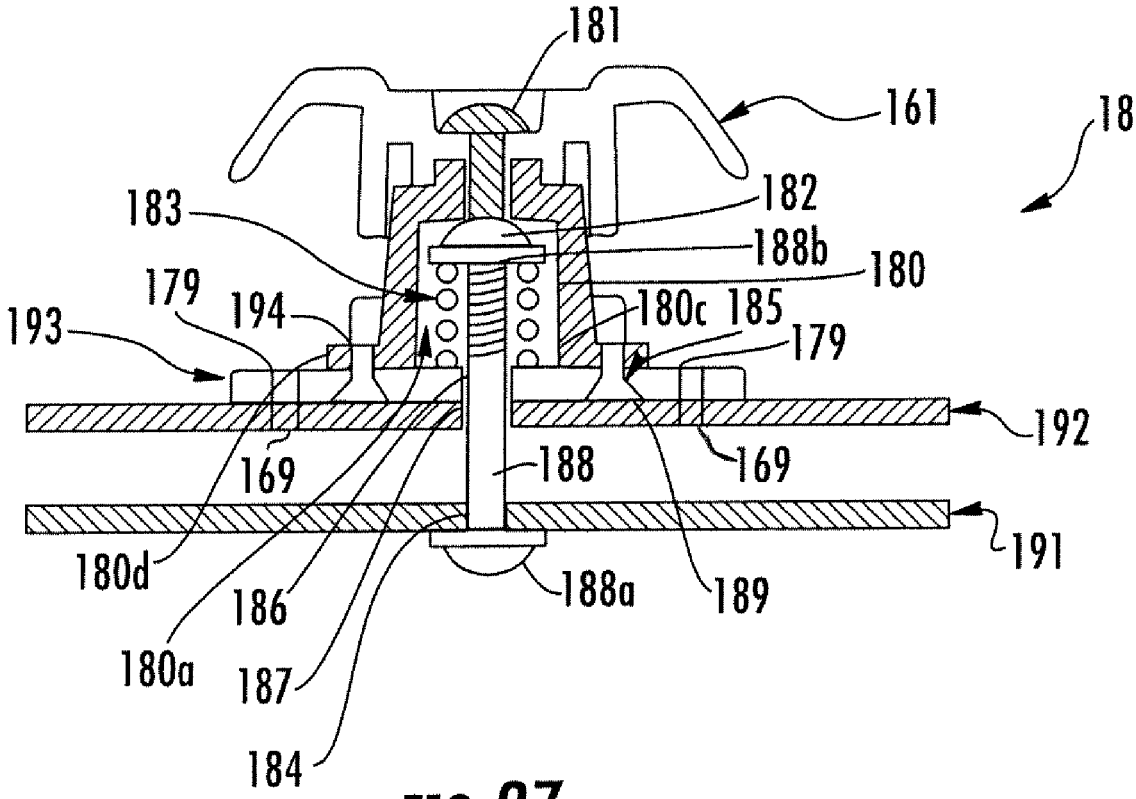
FIG. 27 shows a cross-section view of a locking mechanism according to one embodiment of the invention.
Figure 28:
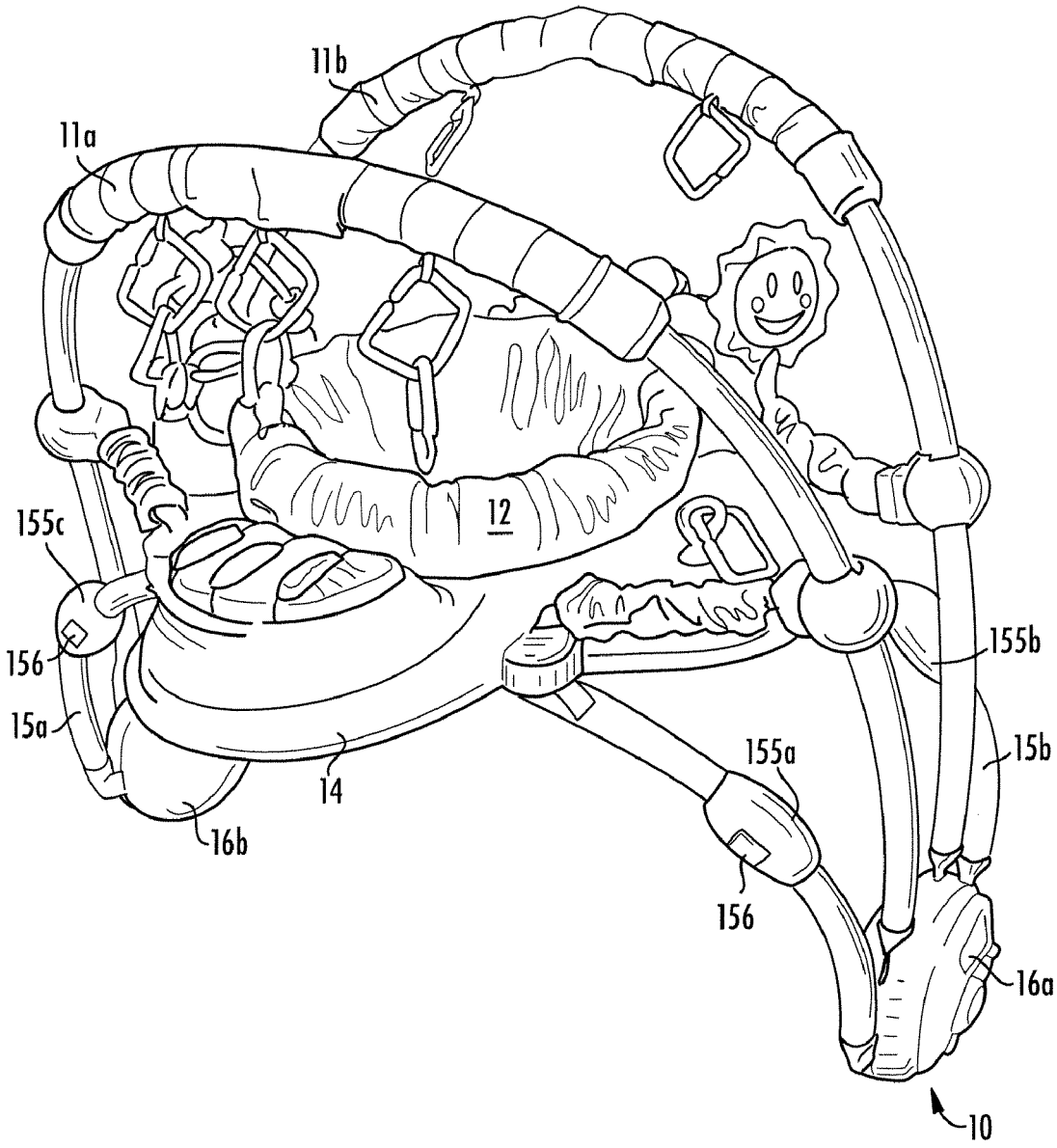
FIG. 28 shows a perspective view of a stationary child exercise apparatus in a folded position according to one embodiment of the invention.
Figure 29:
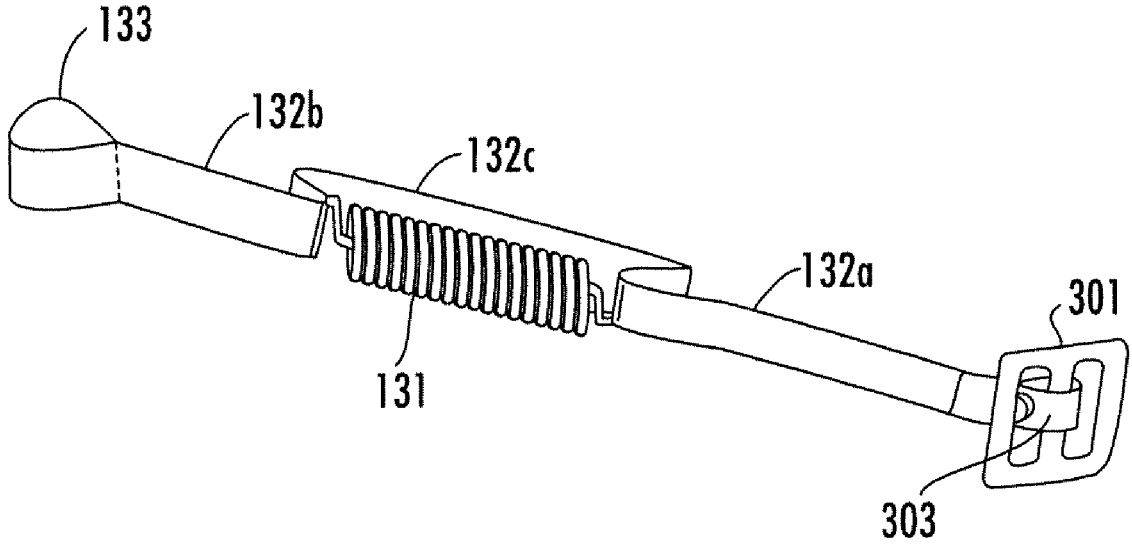
FIG. 29 shows a perspective view of a resilient member according to one embodiment of the invention.

In addition, in the embodiments shown in FIGS. 24, 25, and 27, each stationary hubs 16*a*, 16*b* further includes a locking mechanism 18 for preventing unintentional movement of the frame members 11*a*, 11*b*, 15*a*, 15*b* between the folded position and the extended position. The locking mechanism 18 according to one embodiment includes a plurality of set pins 174 and a stop pin 176, which each extend generally perpendicularly from the surface of the second guide plate 192, and a locking plate 193 that defines a plurality of set slots 175 that are each configured to receive one of the set pins 174, a stop guide slot 177 configured to receive the stop pin 176, and first 179*a* and second locking slots 179*b*. Locking slots 179*a* are adapted to receive second guide pins 168 when the frame members 11*a*, 11*b*, 15*a*, 15*b* are in the extended position, and locking slots 179*b* are adapted to receive second guide pins 168 when the frame members 11*a*, 11*b*, 15*a*, 15*b* are in the folded position.

The set pins 174, the set slots 175*a*, 175*b*, the stop guide pin 176, and the stop guide slot 177 assist in aligning the locking slots 179*a*, 179*b* with the position of the second guide pins 168 when the frame members 11*a*, 11*b*, 15*a*, 15*b* are moved between the expanded and folded positions. For example, set slots 175*a* are moved to receive set pins 174 when the frame members 11*a*, 11*b*, 15*a*, and 15*b* are to be moved into the extended position, and set slots 175*b* are moved to receive set pins 174 when the frame members 11*a*, 11*b*, 15*a*, and 15*b* are to be moved into the folded position. In addition, the stop guide pin 176 is configured to move between each end of the stop guide slot 177 depending on whether the frame members 11*a*, 11*b*, 15*a*, and 15*b* are to be moved into the expanded position or into the folded position. Furthermore, according to various embodiments, an inner surface of the locking plate 193 is configured to be biased against the outer surface of the second guide plate 192 to prevent the second guide pins 168 from becoming disengaged with the locking slots 179*a*, 179*b*.

According to the embodiments shown in FIGS. 24, 25, and 27, to move the set slots 175 and the stop guide slot 177 relative to the set pins 174 and stop guide pin 176, respectively, the locking plate 193 is configured to rotate about an axis of rotation $R_L$ that extends through the locking plate 193. In particular, the set slots 175 and the stop guide slot 177 are positioned radially about the axis of rotation $R_L$ of the locking plate 193 such that by rotating the locking plate 193 in a first direction or a second direction, which is opposite of the first direction, the set slots 175*a*, 175*b* associated with the desired position (the expanded position or the folded position) are aligned with the set pins 174. According to one embodiment, the locking plate 193 is rotated by (1) pulling a knob 161 that is coupled to the locking plate 193 in a substantially perpendicular direction away from the second guide plate 192 to allow the set pins 174 to disengage from the set slots 175 and the second guide pins 168 to disengage from the locking slots 179, (2) turning the knob 161 in a first direction or a second direction about the axis of rotation $R_L$, depending on whether the user desires to move the frame members 11*a*, 11*b*, 15*a*, 15*b* into the folded position or expanded position, and (3) releasing the knob 161 if the locking plate 193 is biased against the second guide plate 192 or otherwise urging the knob 161 toward the second guide plate 193 to engage the set pins 174 into the set slots 175 and the second guide pins 168 into the locking slots 179.

FIG. 27 illustrates the locking mechanism 18 according to a particular embodiment of the invention in which the locking plate 193 is biased toward to the second guide plate 192. In particular, the locking plate 193 further defines a central aperture 186 through its axis of rotation $R_L$, and the first 191 and second guide plates 192 further define apertures 187, 184 that align with the central aperture 186 of the locking plate 193. To couple the locking plate 193 adjacent the second guide plate 192, a pin 188 that has a head 188*a* and a end 188*b* that defines internal threads is engaged through the apertures 184, 187, 186 such that the head 188*a* seats adjacent the surface of the first guide plate 191 and the end 188*b* of the pin 188 extends through and outwardly from aperture 186. A helical compression spring 183 is placed around the end 188*b* and is positioned adjacent the aperture 186 on surface of the locking plate 193. The spring 183 is removably secured into position by engaging an externally threaded screw 182 into the end 188*b* of the pin 188. The locking mechanism 18 further includes a coupling shaft 180 that defines a hollow interior portion 180*a*, a first end 180*b*, and a second end 180*c*. The first end 180*b* is substantially solid and defines an aperture for receiving a screw 181 to secure the knob 161 adjacent the coupling shaft 180. The hollow interior portion 180*a* is adapted for receiving the spring 183 and screw 182 such that the second end 180*c* seats adjacent the locking plate 193. The second end 180*c* further defines an annular collar 180*d* that includes apertures 189 that align with apertures 194 in the locking plate 193 for receiving screws 185 that securely couple the locking plate 193 to the annular collar 180*d* of the coupling shaft 180. In addition, the guide plates 191, 192, the locking plate 193, the knob 161, and coupling shaft 180 may be formed of any suitable rigid material, such as metal (e.g., steel) or plastic.

In one embodiment, the first end 180*b* of the coupling shaft 180 extends from an aperture defined in the housing 160 of each stationary hub 16*a*, 16*b* such that the knob 161 may be coupled to the coupling shaft 180 outside of the housing 160. In an alternative embodiment, the first end 180*b* of the coupling shaft 180 remains inside of the housing 160 and a portion of the knob 161 is configured to extend through the aperture in the housing 160 such that the knob 161 is coupled to the coupling shaft 180 inside of the housing 160.

In another embodiment, which is not shown, the locking mechanism 18 further includes a secondary locking plate that is configured to prevent locking plate 193 from being urged away from the second guide plate 192. In one embodiment, the secondary locking plate is pivotably coupled to the second guide plate 192 (e.g., via a pivot pin and pivot slot or a rivet) adjacent an outer edge of the locking plate 193. At least a portion of the secondary locking plate is urged over at least a portion of the locking plate 193 when the user wants to prevent the locking plate 193 from being moved relative to the second guide plate 192, and the second locking plate is urged away from any contact with the locking plate 193 when the user wants to be able to move the locking-plate 193 relative to the second guide plate 192. In a particular embodiment shown in FIGS. 21 and 22, a secondary knob 162 is coupled to the secondary locking plate to facilitate the engagement and disengagement of the secondary locking plate with respect to the locking plate 193.

Seat

The seat 12, according to one embodiment, includes a seat carrier ring 201 and a seat support ring 211. As shown schematically in FIG. 9, an annular horizontal surface 202 on the seat carrier ring 201 is mounted adjacent to and vertically supported by an annular horizontal surface 212 of the seat support ring 211, and a central axis B of the seat support ring 211 is coaxial with a central axis A of the seat carrier ring 201. Thus, the seat carrier ring 201 can rotate 360° about the axis A, independently of the seat support ring 211.

Figure 9:
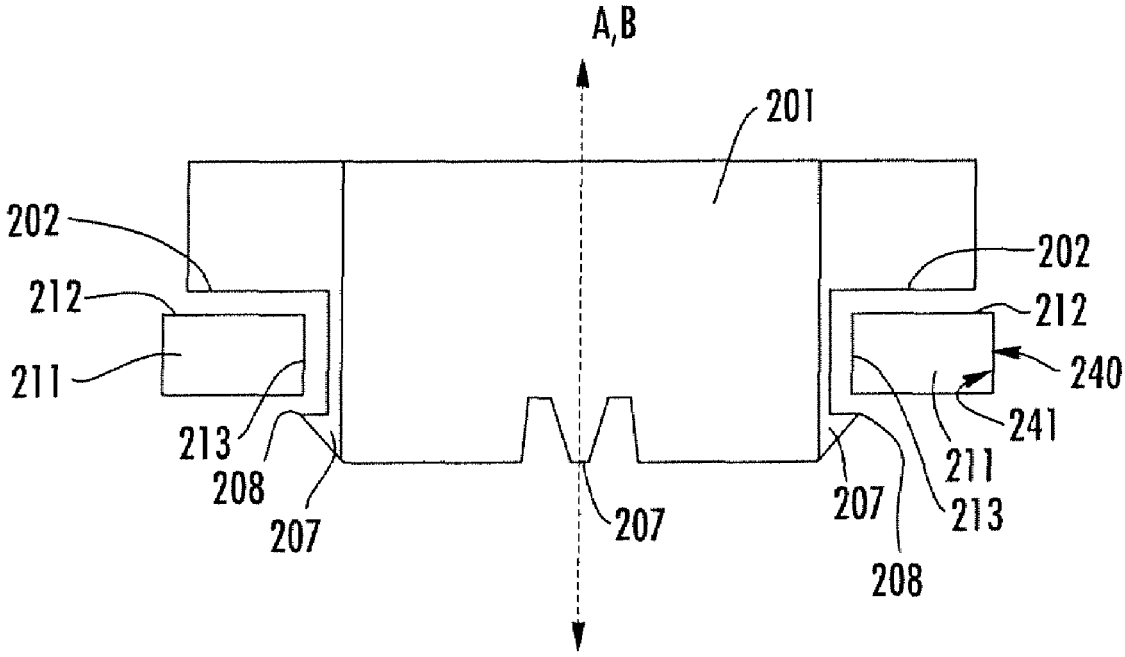
FIG. 9 shows a cross-sectional view of a seat carrier ring and a seat support ring according to one embodiment of the invention.
Figure 10:
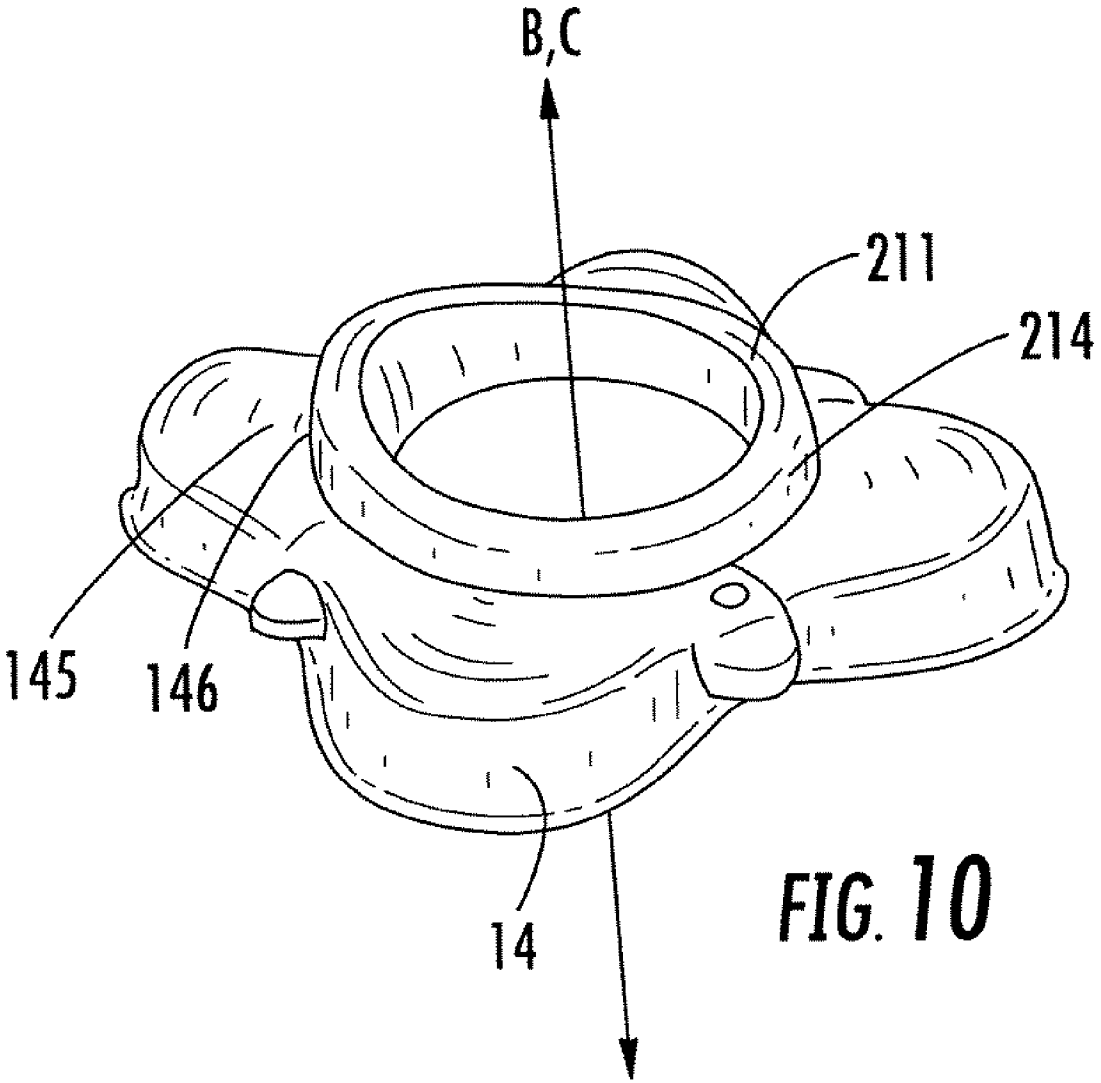
FIG. 10 shows a perspective view of an activity table and a seat support ring according to one embodiment of the invention.
Figure 11:
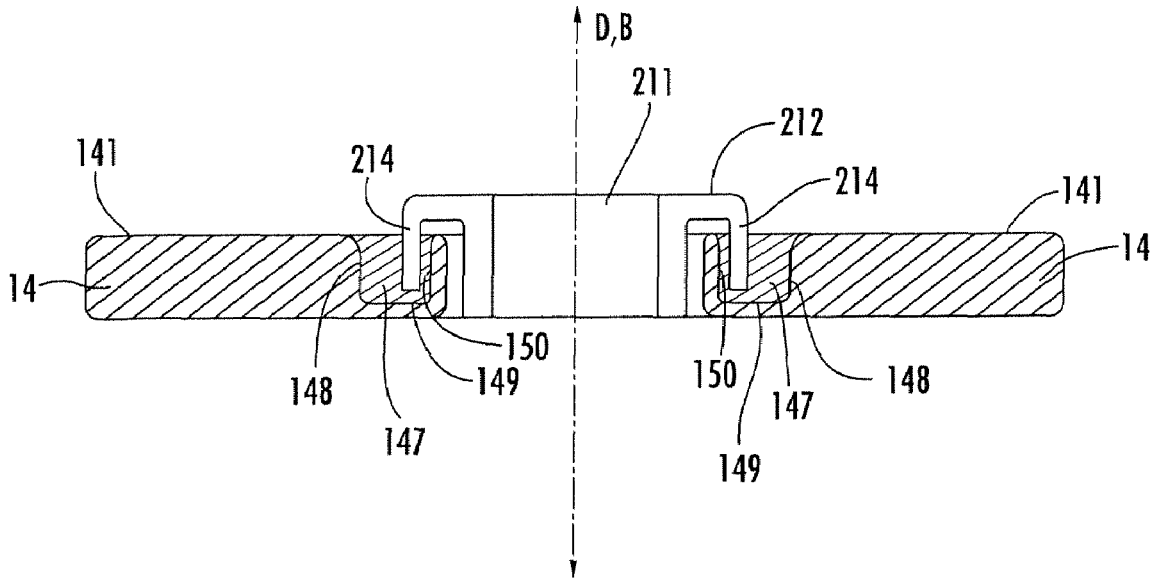
FIG. 11 shows a cross-sectional view of an activity table and a seat support ring according to one embodiment of the invention.

As shown in FIGS. 9 through 11, one embodiment of the seat support ring 211 has a central vertical axis B and includes an inner wall 213, an outer wall 214, and an annular horizontal engagement surface 212 positioned between the inner 213 and outer walls 214. The width of the annular horizontal engagement surface 212 is wide enough to provide vertical support for a seat carrier ring 201 mounted adjacent to the horizontal engagement surface 212. As will be discussed below in more detail in the section below entitled "Activity Table," in various embodiments shown in FIGS. 1-3, 5-7B and 10, the seat support ring 211 is integrally formed with an activity table 14, and in other embodiments, such as shown in FIG. 11, the seat support ring 211 is separate from the activity table 14.

Figure 12:
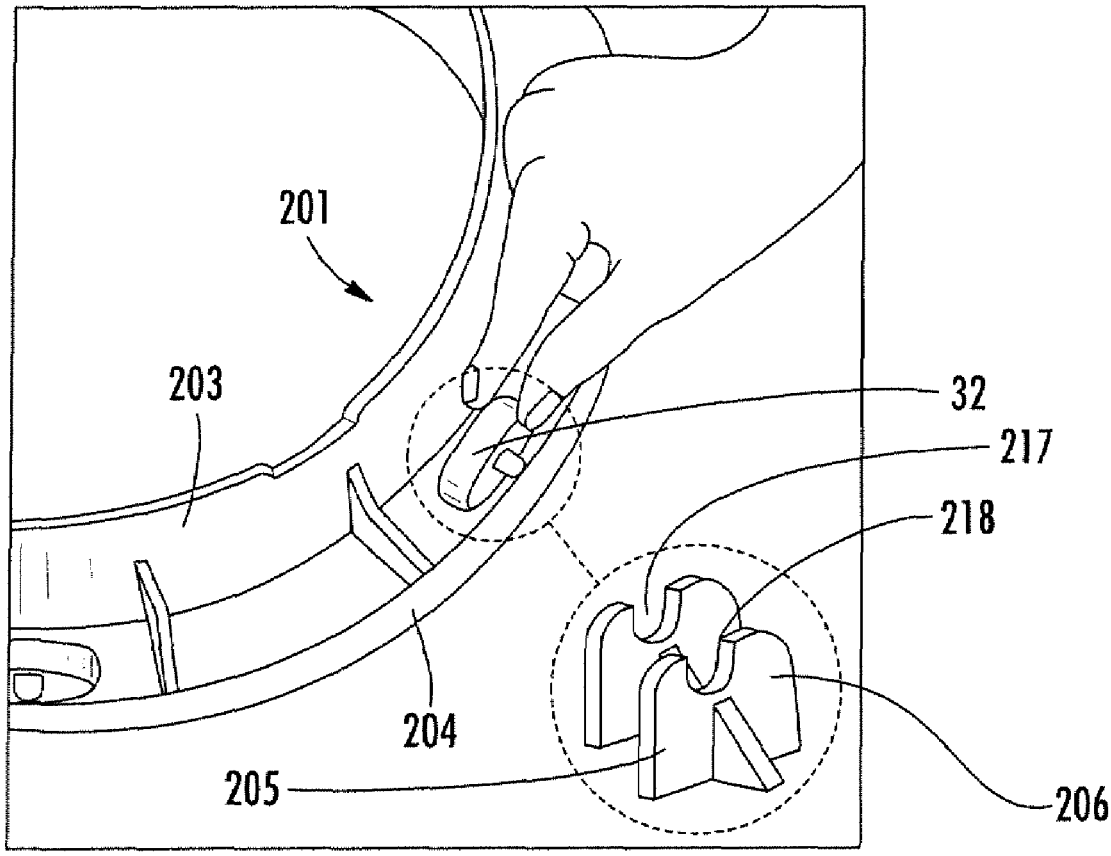
FIG. 12 shows a perspective view of a seat carrier ring according to one embodiment of the invention.
Figure 13:
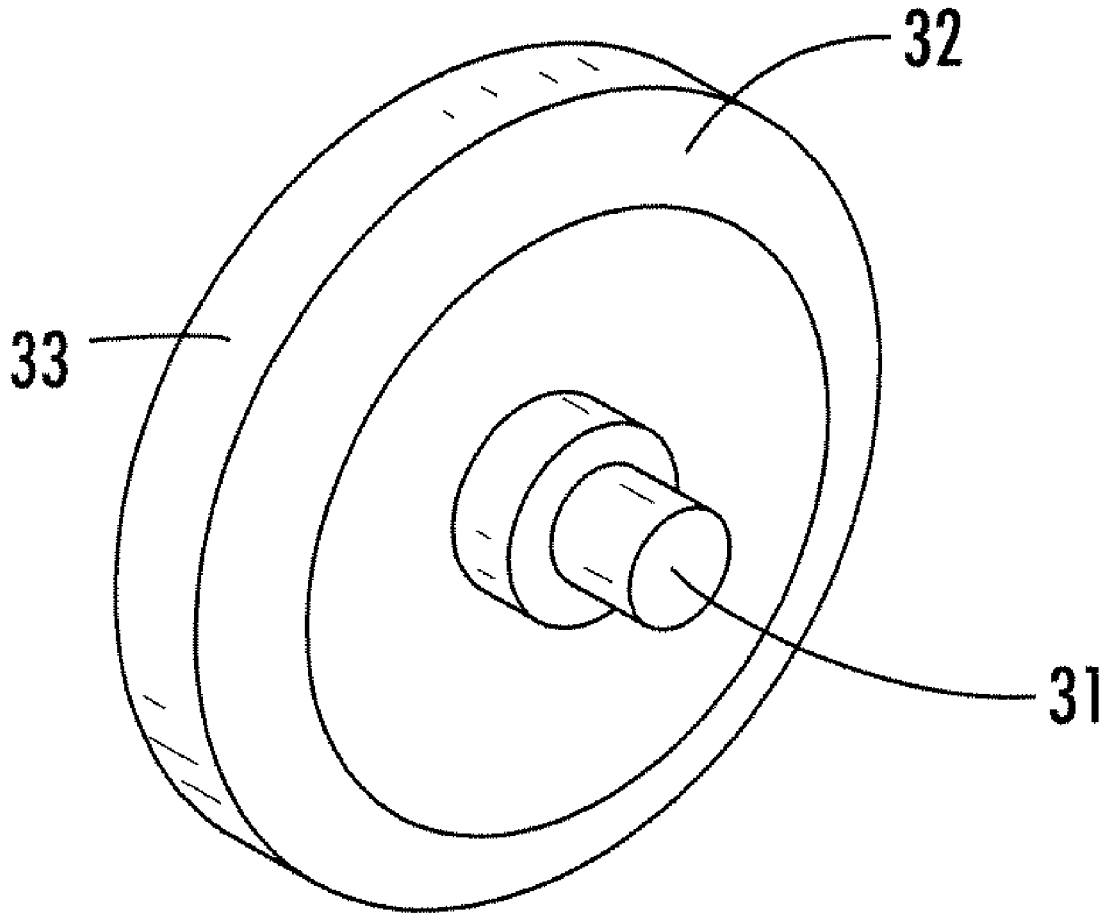
FIG. 13 shows a perspective view of a wheel according to one embodiment of the invention.

As mentioned above, the seat carrier ring 201 has a central vertical axis A and includes an inner wall 203, an outer wall 204, and a horizontal annular surface 202 positioned between the inner 203 and outer walls 204. In one embodiment, shown in FIGS. 8 and 12, the horizontal annular surface 202 of the seat carrier ring 201 includes a plurality of ribs 205 positioned between the inner wall 203 and outer wall 204. Each of the ribs 205 defines a mounting portion 206 that receives a roller 32. According to one embodiment, as shown in FIG. 12, the mounting portion 206 has a C-shaped cross section and defines an aperture 217 having the approximate diameter of an axis 31 of a wheel 32, shown in FIG. 13, and an opening 218 into the aperture 217 that has a width slightly less than the diameter of the axis 31 of the wheel 32. Thus, the axis 31 of the wheel 32 can be snapped into the C-shaped mounting portion 206. When the seat carrier ring 201 is positioned within the seat support ring 211, outer surfaces 33 of the wheels 32 engage the horizontal surface 212 of the seat support ring 211, and the wheels 32 rotate about their axes 31 to facilitate the rotation of the seat carrier ring 201 relative to the seat support ring 211.

Figure 8:
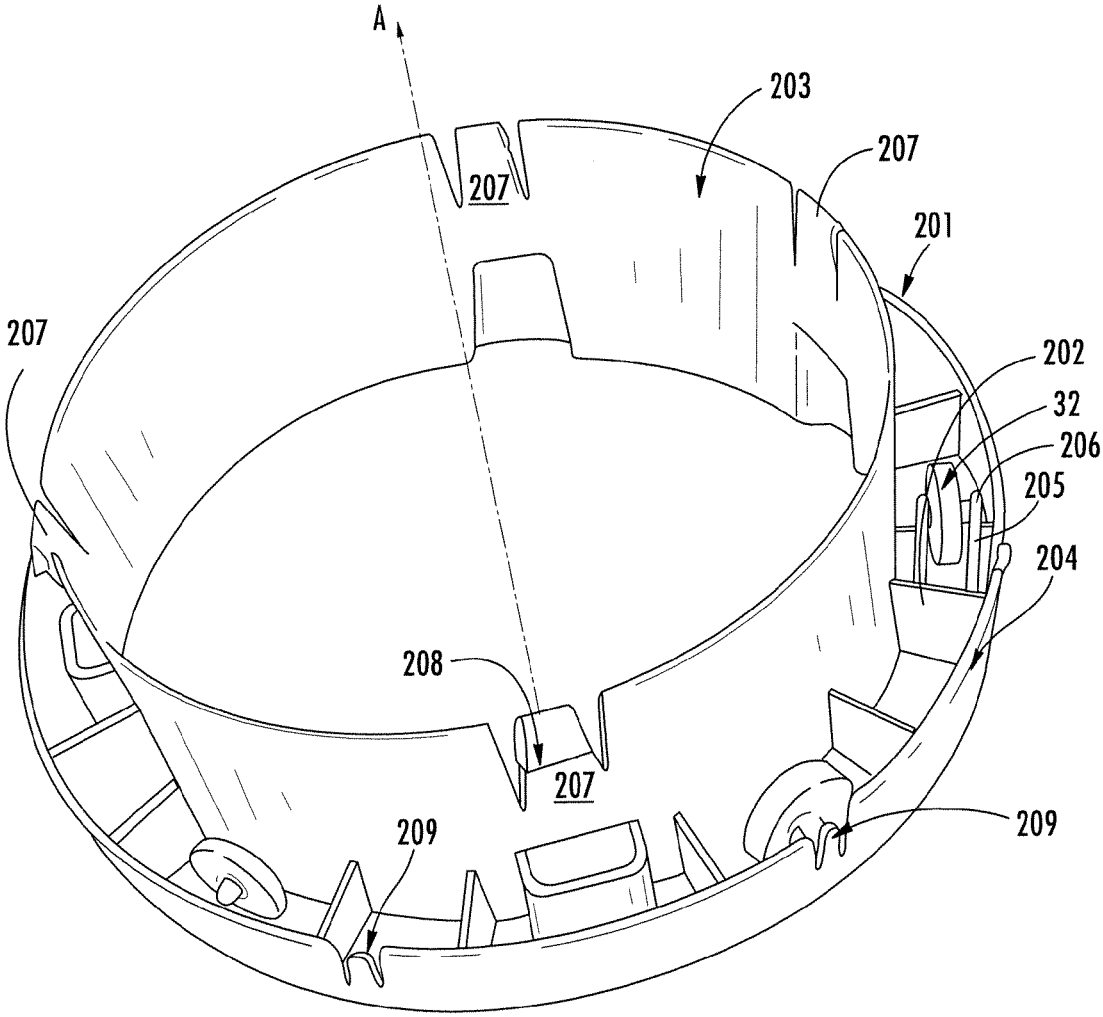
FIG. 8 shows a perspective view of a seat carrier ring according to one embodiment of the invention.

In a further embodiment, as shown in FIG. 8, the inner wall 203 of the seat carrier ring 201 extends below the lower surface 202 and includes one or more cantilevered latches 207. The cantilevered latches 207 include a horizontal shelf 208 that extends away from the central axis A of the seat carrier ring 201. The latches 207 are configured to deflect slightly inwardly towards the central axis A when the seat carrier ring 201 is inserted into the seat support ring 211. As shown in FIG. 9, when the seat carrier ring 201 is fully inserted into the seat support ring 211, the horizontal shelves 208 of the latches 207 are positioned below the inner wall 213 of the seat support ring 211 such that each horizontal shelf 208 is adjacent the bottom edge of the inner wall 213 of the seat support ring 211, preventing the seat carrier ring 201 from being unintentionally removed from the seat support ring 211. To remove the seat carrier ring 201 from the seat support ring 211, the latches 207 are pushed inwardly as the seat carrier ring 201 is urged upwardly.

Figure 14:
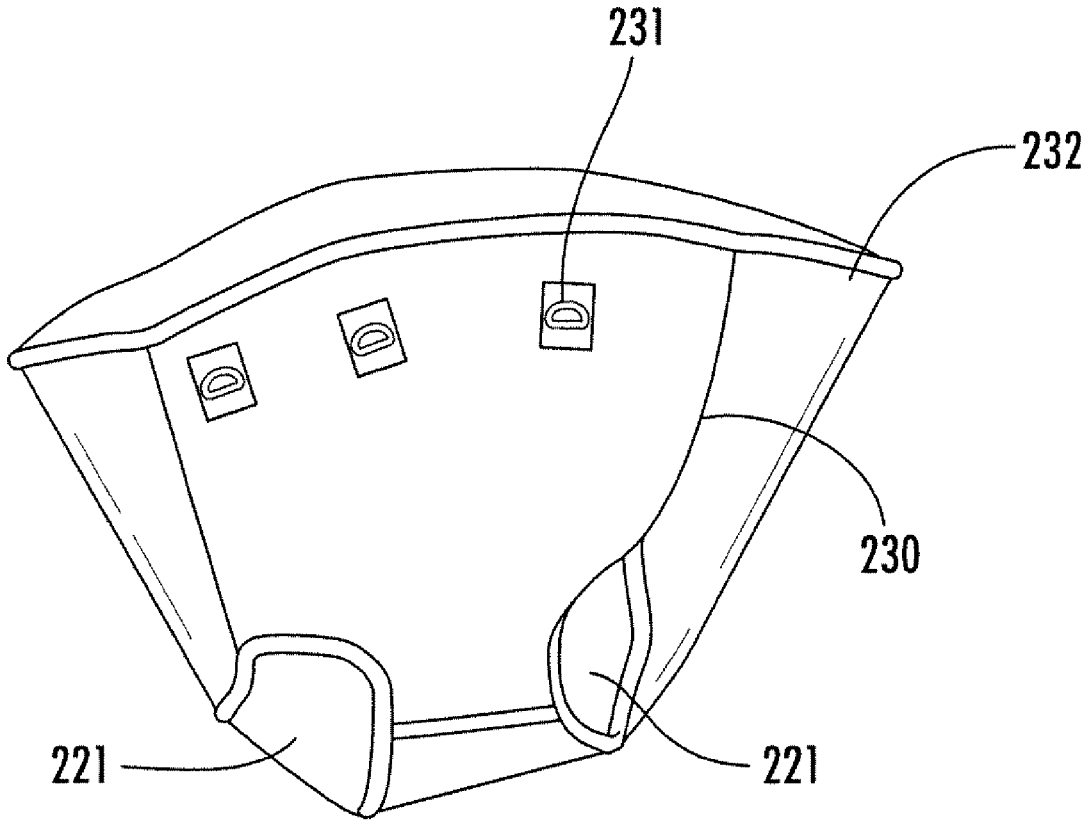
FIG. 14 shows a perspective view of a sling according to one embodiment of the invention.
Figure 16:
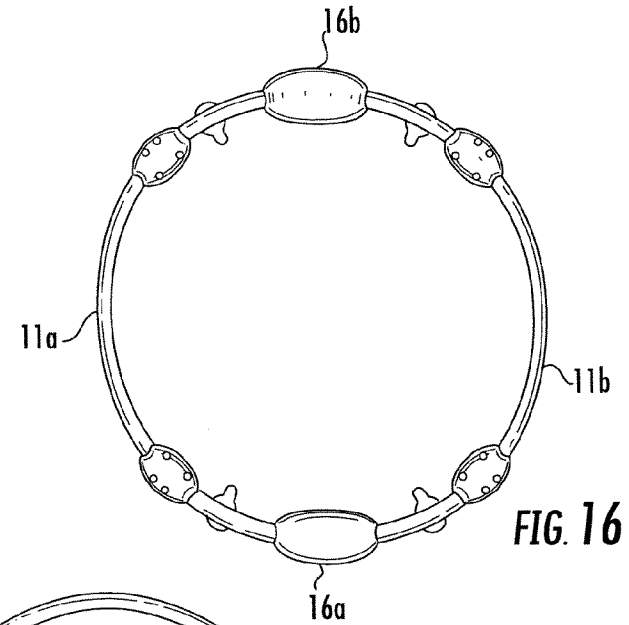
FIG. 16 shows a top view of the frame structure in FIG. 15.
Figure 18:
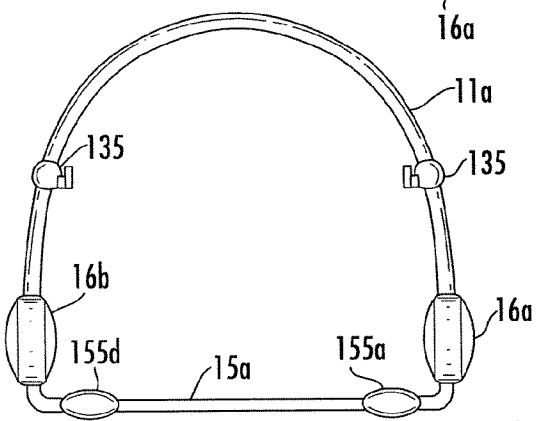
FIG. 18 shows a second side view of the frame structure in FIG. 15.

FIG. 14 illustrates one embodiment of a fabric sling 230 that attaches to the seat carrier ring 201. Once attached to the seat carrier ring 201, the child can sit on the sling 230. In one embodiment, the sling 230 includes a pair of leg openings 221 that allow the child to touch the floor with its legs. In addition, the sling 230 includes loops 231 along a top portion 232 of the sling 230 to engage tabs 209, shown in FIG. 8, that extend downwardly from the outer wall 204 of the seat carrier ring 201. To secure the fabric sling 230 to the seat carrier ring 201, the sling 230 is positioned through the center of the seat carrier ring 201, the top portion 232 of the sling 230 is wrapped over the outer wall 204 of the seat carrier ring 201, and the loops 231 are hooked over the tabs 209. Alternatively, snaps, buttons, clips, or other suitable fasteners may be used to secure the sling 230 to the seat carrier ring 201.

Resilient Member

As discussed above, embodiments of the exercise apparatus 10 shown in FIGS. 1 and 2 include one or more resilient members 13*a-d* that extend between the upper frame members 11*a*, 11*b* and the seat 12, suspending the seat 12 above the support surface (e.g., floor or ground). The resilient members 13*a-d* have a resiliency that allows the child to bounce vertically by pushing its legs downwardly against the support surface. The resiliency may be provided by one or more portions of the resilient member 13*a-d* or the entire resilient member 13*a-d*.

According to various embodiments, at least a portion of the resilient members 13*a-d* are formed using various types of materials that provide resiliency. For example, in one embodiment, each resilient member 13*a-d* comprises a resilient portion 131 that may be formed of a helical metal tension spring or a flexible material, such as natural or synthetic elastomers, rubber, or woven polypropylene. Various embodiments of the resilient members 13*a-d*, such as the embodiments shown in FIGS. 29-34, further include a fabric portion 132. In other embodiments, the fabric portion 132 may be formed of other materials, such as nylon or fabric mesh.

For example, according to embodiments shown in FIGS. 29-32, the resilient member 13*a-d* includes a resilient portion 131 extending between first and second fabric portion 132*a*, 132*b*. According to one embodiment, the resilient portion 131 includes a helical metal tension spring, and the fabric portions 132 include a fabric weave. Each end of the resilient portion 131 is coupled to the fabric portions 132*a*, 132*b* (e.g., sewn, welded, or other methods known in the art). The first fabric portion 132*a* is adapted to be coupled to the seat 12, and the second fabric portion 132*b* is adapted to be coupled to the upper frame member 11*a*, 11*b*. In addition, a third fabric portion 132*c* extends between the first 132*a* and second fabric portions 132*b* to serve as a safety feature for preventing the seat 12 from falling to the support surface if the resilient portion 131 breaks or for preventing the resilient portion 131 from overextending. In addition, each resilient member 13*a-d* includes a cover 335 to protect the child within the apparatus 10 from being pinched by the resilient members 13*a-d*.

Figure 30:
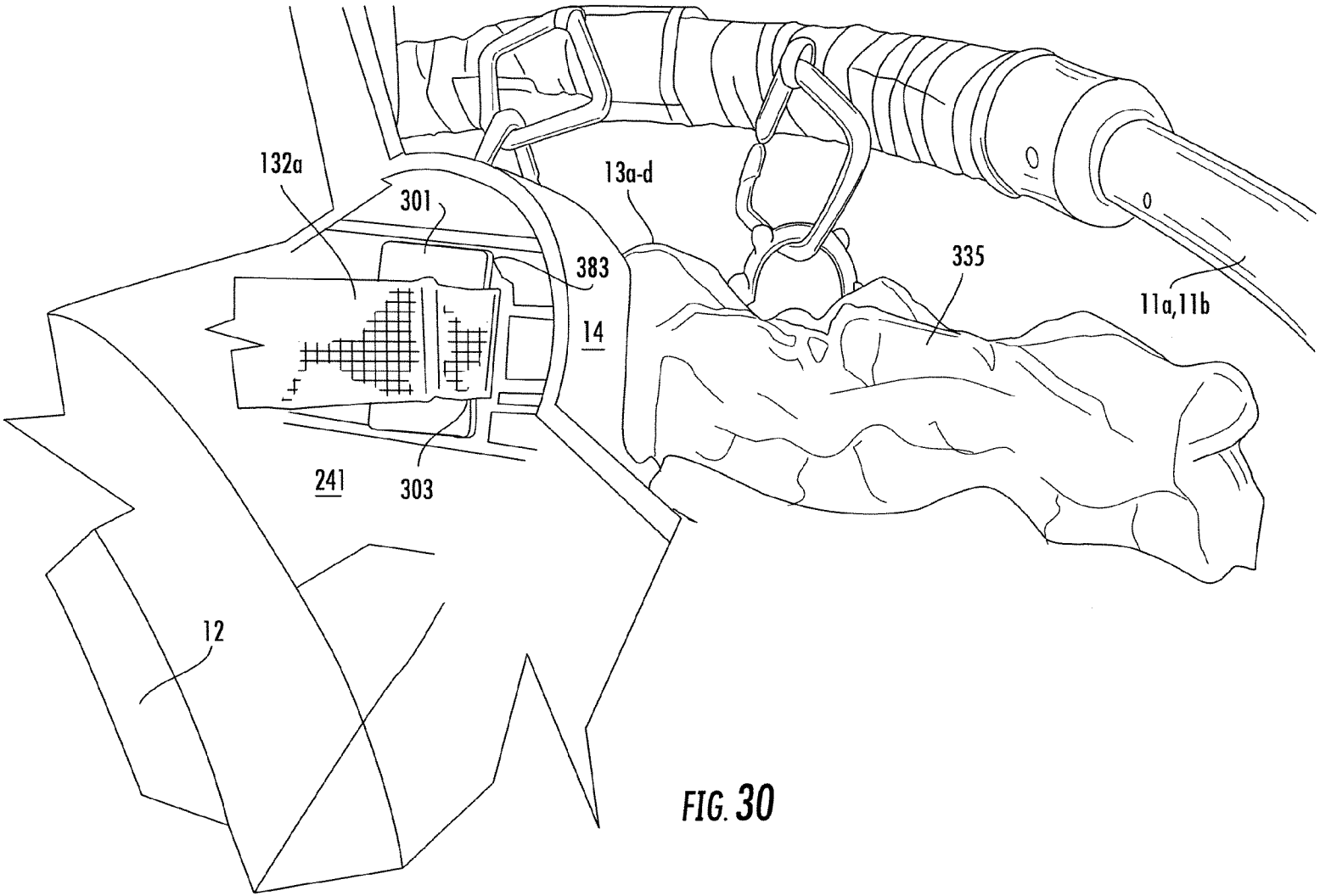
FIG. 30 shows a perspective view of a resilient member and an activity table according to one embodiment of the invention.
Figure 31:
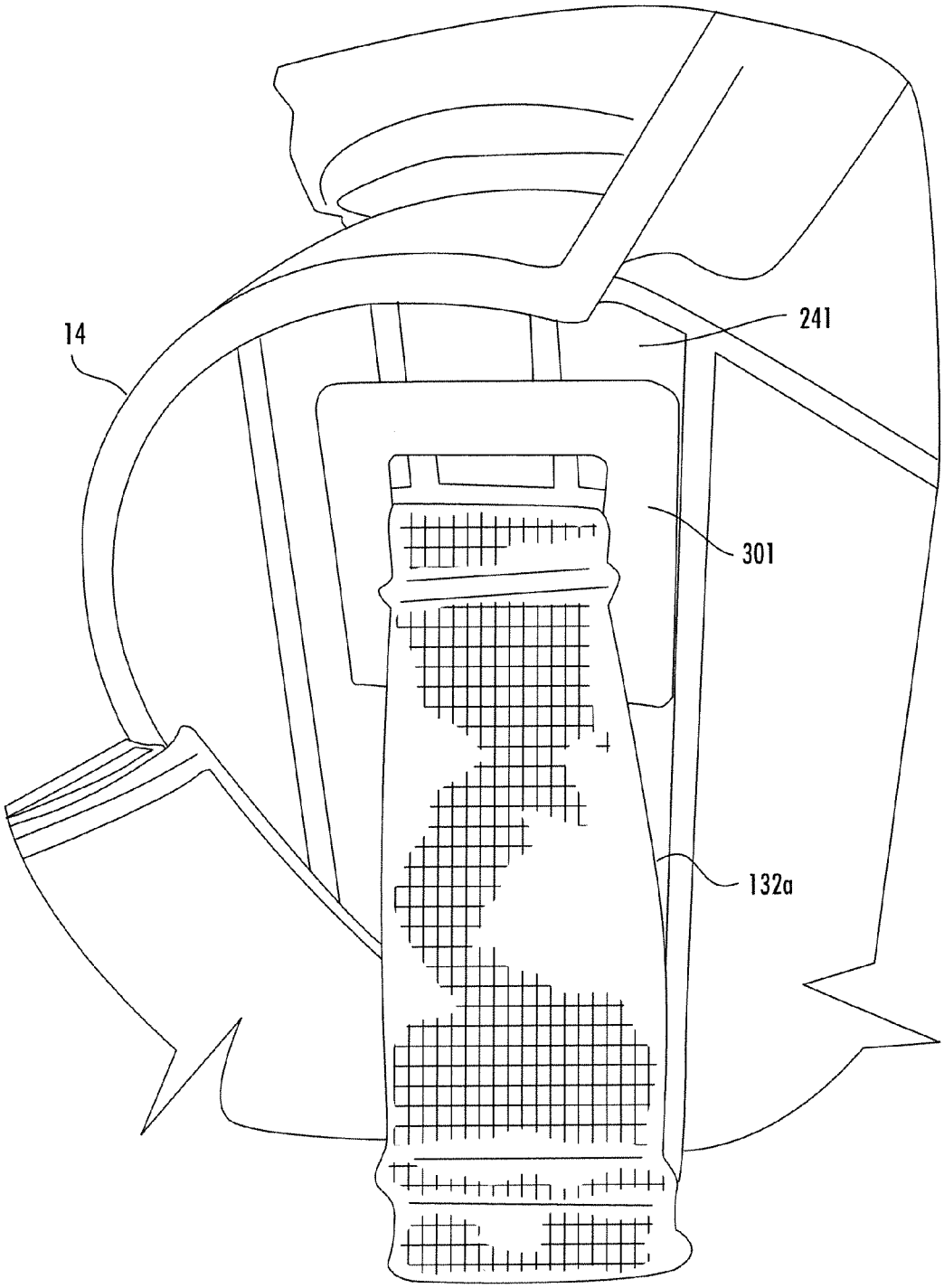
FIG. 31 shows a perspective view of the resilient member coupled to the activity table according to the embodiment shown in FIG. 30.

As mentioned above, the first fabric portion 132*a* of each resilient member 13*a-d* is configured to be coupled to the seat 12 or the activity table 14 according to various embodiments of the invention. For example, in the embodiments shown in FIGS. 29-31, the activity table 14 defines a plurality of slots 383 extending through the activity table 14 and positioned on the upper surface 141 of the activity table 14. An end portion 303 of the first fabric portion 132*a* is coupled to a buckle 301, and the buckle 301 is configured to be threaded through one of the slots 383 from the upper surface 141 toward an inner surface 241 in a first orientation, which is shown in FIG. 30, and then moved to a second orientation, which is shown in FIG. 31, to engage the inner surface 241 of the activity table 14. In the embodiments shown in FIGS. 3, 30, and 31, the slot 383 is positioned on an upper surface 141 of the table 14. However, in the embodiments shown in FIGS. 1 and 2, the slot 383 is positioned on a side surface 240 of the activity table 14. In other embodiments (not shown), the slot 383 may be positioned on the seat 12.

In addition, as mentioned above, the second fabric portion 132*b* of each resilient member 13*a-d* is coupled to one of the upper frame members 11*a*, 11*b*. In one embodiment, the second fabric portion 132*b* defines a loop 133 that is adapted for receiving one of the upper frame members 11*a*, 11*b* therethrough. In addition, according to the embodiments shown in FIGS. 32-24, the loop 133 is secured into a particular position along the upper frame members 11*a*, 11*b* with a resilient member connector 135.

Figure 32:
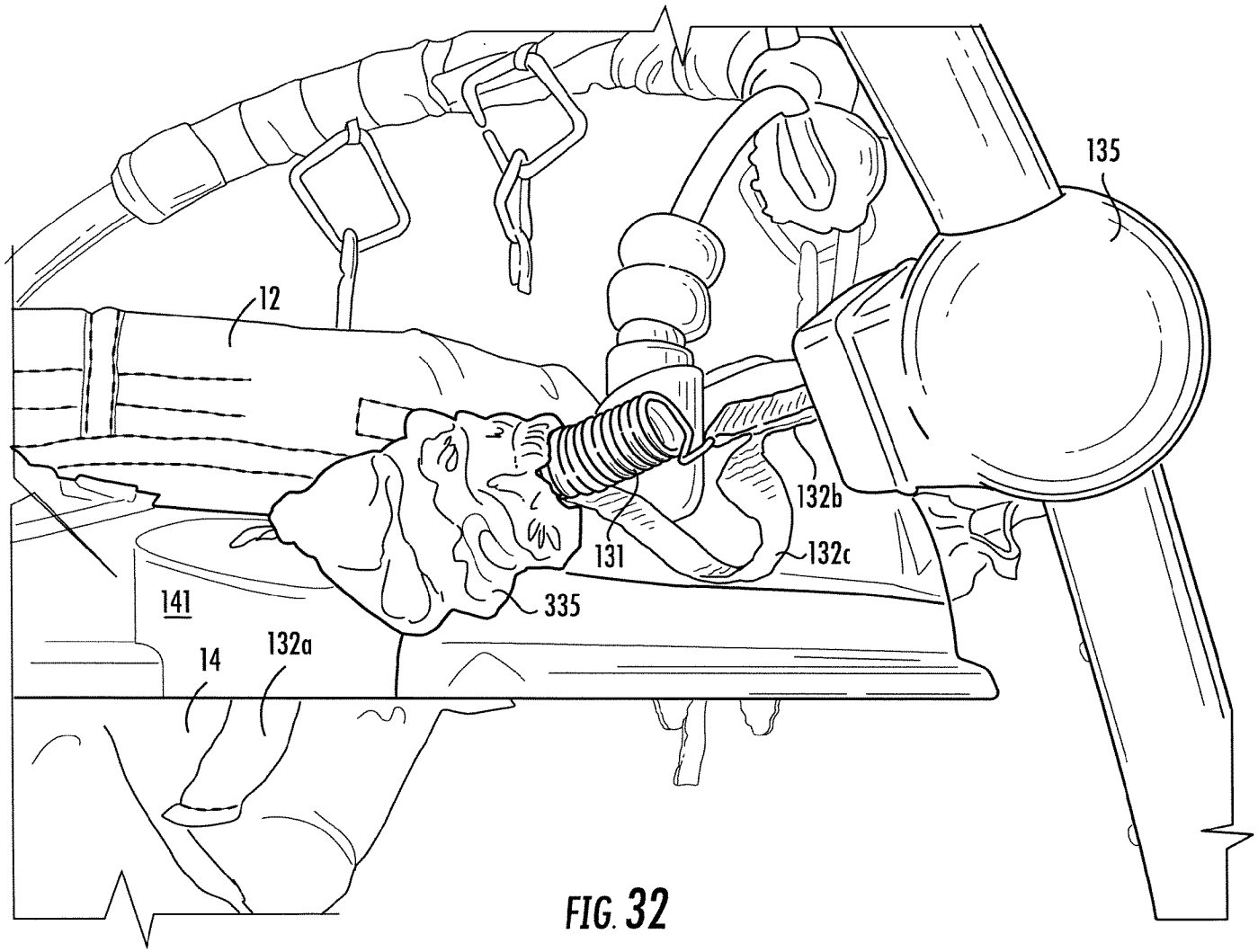
FIG. 32 shows a perspective view of the resilient member coupled to a frame member according to one embodiment of the invention.
Figure 33:
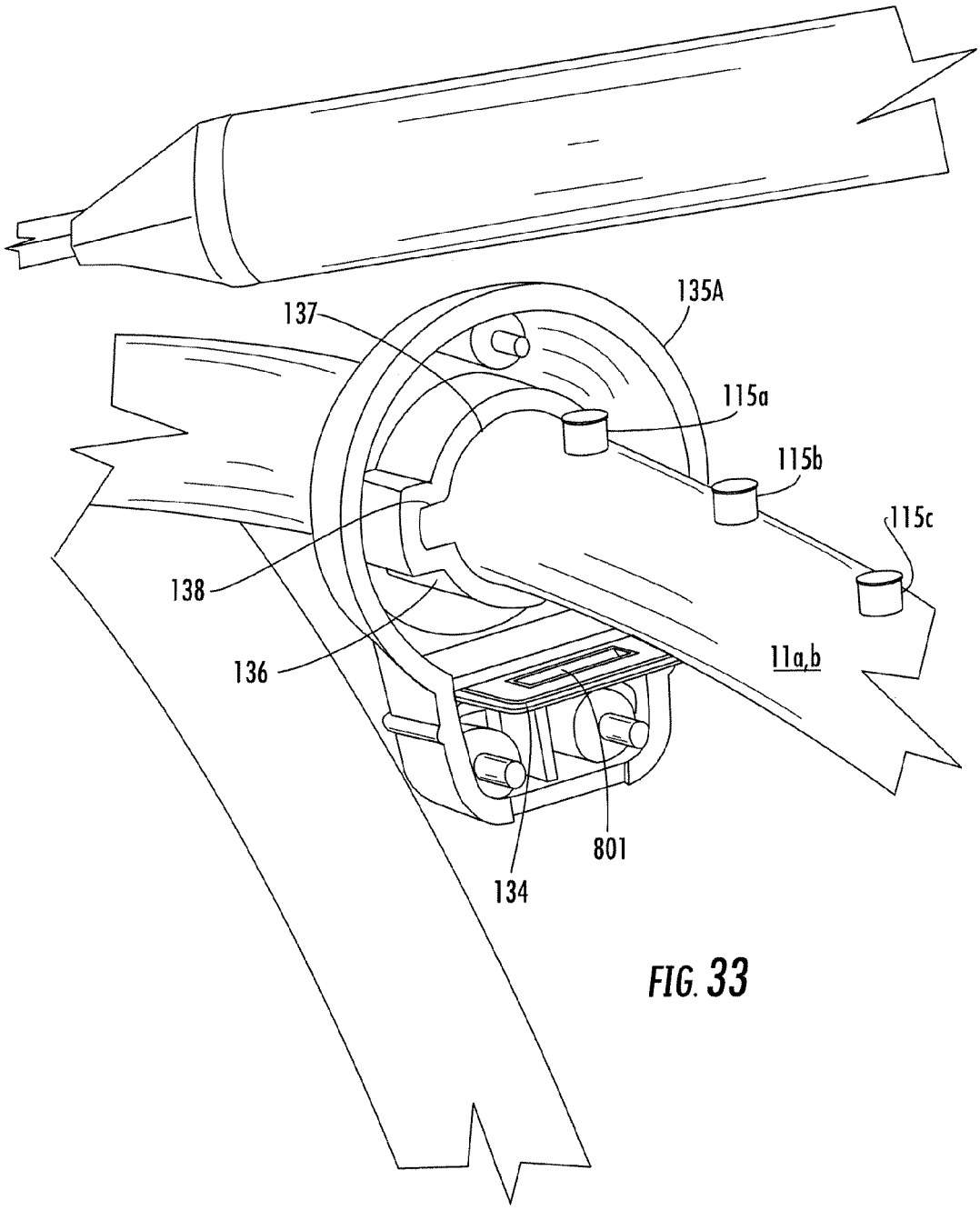
FIG. 33 shows a perspective view of a resilient member connector according to one embodiment of the invention.

In one embodiment, which is shown in FIGS. 32-24, each resilient member connector 135 includes a first portion 135*a* and a second portion 135*b* that are adapted for receiving the loop 133 and a portion of the second fabric portion 132*b* between them and being removably secured together (e.g., via fasteners or a snap fit connection). In particular, as shown in FIG. 33, the first portion 135*a* of the resilient member connector 135 includes a tab 134 that extends from the first portion 135*a* toward the second portion 135*b*, and the tab 134 defines a slot 801 for receiving the loop 133 and a portion of the second fabric portion 132*b*. The second portion 135*b* of the resilient member connector 135 defines a recess (not shown) for receiving the tab 134 and the portion of the second fabric portion 132*b* that extends through the slot 801 in the tab 134.

Figure 34:
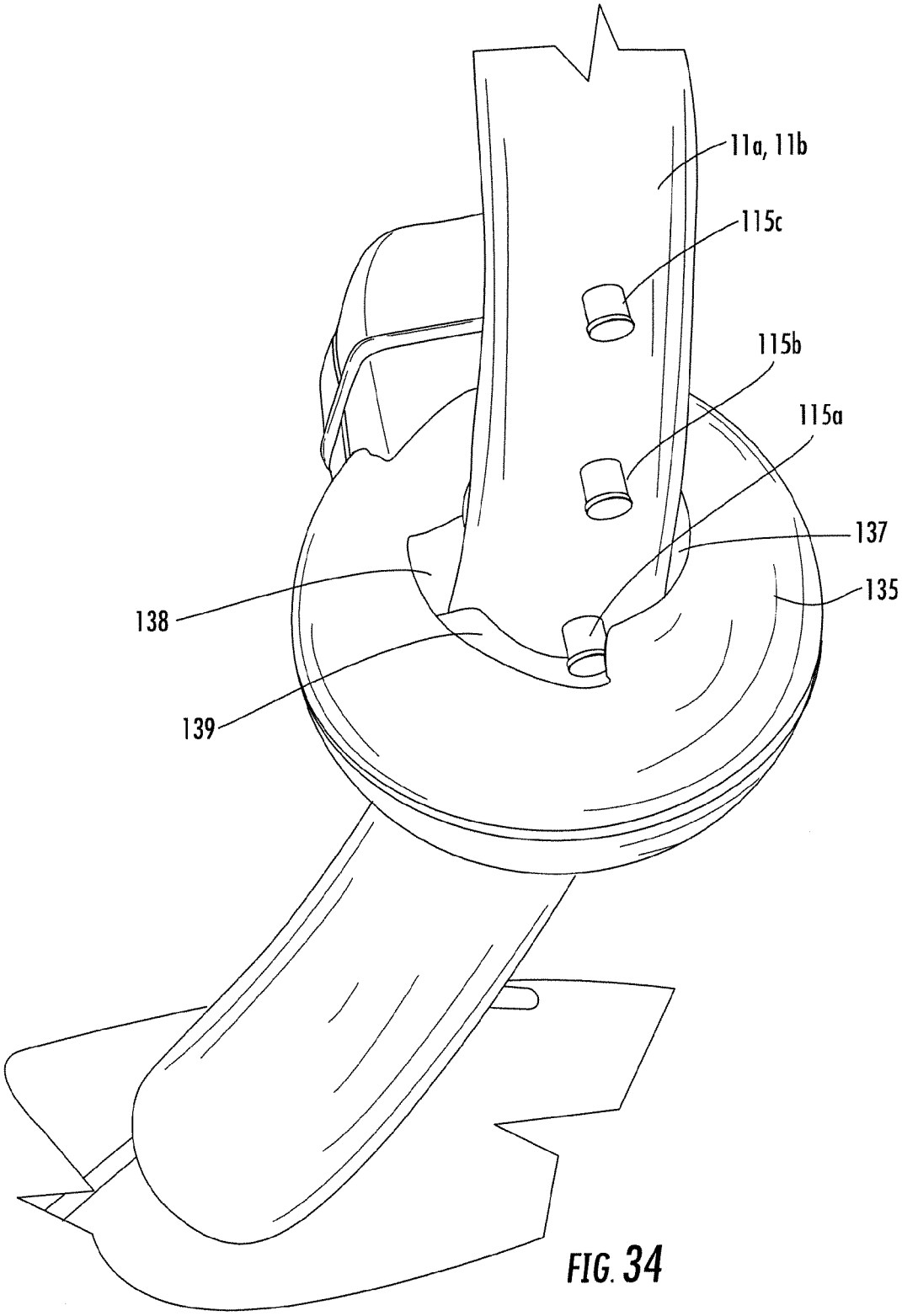
FIG. 34 shows a perspective view of a resilient member connector according to one embodiment of the invention.

In addition, each portion 135*a*, 135*b* defines a keyhole shaped aperture 136 through it. The keyhole shaped aperture 136 includes a first aperture 137 that has inner dimensions that are slightly larger than the outer dimensions of the upper frame members 11*a*, 11*b*, which allows the first aperture 137 to receive the upper frame members 11*a*, 11*b*, and a second aperture 138 that has inner dimensions that are slightly larger than the outer dimensions of the protrusions 115*a-c* that extend from the upper frame members 11*a*, 11*b*, which allows the second aperture 138 to receive the protrusions 115*a-c*. Furthermore, as shown in FIG. 34, the outer surface of each portion 135*a*, 135*b* of the resilient member connectors 135 further includes a guide surface 139 that extends between the second aperture 138 and the outer surface of the resilient member connector 135. The guide surface 139 is configured for leading one of the protrusions 115*a-c* toward the second aperture 138.

To adjust the height of the seat 12 relative to the support surface, the user moves the guide surface 139 of the resilient member connector 135 adjacent to one of the protrusions 115*a-c* on the upper frame members 11*a*, 11*b*, and twists the resilient member connector 135 in a first direction such that the second aperture 138 of the resilient member connector 135 aligns with the protrusion 115*a-c*. The user moves the resilient member connector 135 over one or more protrusions 115*a-c* and along the upper frame member 11*a*, 11*b* until the resilient member connector 135 is positioned at the desired height. In one embodiment, the resiliency of the resilient portion 131 of the resilient member 13*a-d* urges the resilient member connector 135 in a second direction, which is opposite of the first direction, to position the protrusion 115*a-c* adjacent the guide surface 139. The engagement of the protrusion 115*a-c* with the guide surface 139 prevents the resilient member connector 135 from moving relative to the upper frame member 11*a*, 11*b*. In other embodiments, the resilient member connector 135 may be twisted by the user in the second direction to align the guide surface 139 with the protrusion 115*a-c*.

In an alternative embodiment (not shown), the resilient member connector 135 may include a biased protrusion extending from an inner surface of the resilient member connector 135 toward the upper frame member 11*a*, 11*b*, and the upper frame member 11*a*, 11*b* may include a plurality of apertures adapted for receiving the biased protrusion. To move the resilient member connector 135 along the upper frame member 11*a*, 11*b*, the user twists the resilient member connector 135 in a first direction to disengage the protrusion from the first aperture, moves the resilient member connector 135 along the upper frame member 11*a*, 11*b*, and then twists the resilient member connector 135 in a second direction (opposite the first direction) to align the biased protrusion with the second aperture, allowing the biased protrusion to engage the second aperture.

Further, in one alternative embodiment (not shown), the resilient members 13*a-d* may include two or more resilient portions 131 and fabric portions 132 that extend between the resilient portions 131. And, in another embodiment (not shown), the resilient members 13*a-d* are comprised entirely of a resilient portion 131. In another alternative embodiment (not shown), the resilient members 13*a-d* comprise one or more elastic or rubber cords and are secured to the upper frame members 11*a*, 11*b* and the seat 12 using tabs or grommets for example. Alternatively, the elastic or rubber cords are threaded through a conduit on the periphery of the seat 12 and pulled into tension when coupled to the upper frame members 11*a*, 11*b*. Further, in another embodiment, the resilient member 13*a*, 13*b* comprises one resilient portion 131 (e.g., an elastic or rubber ring or a helical spring) and one fabric portion 132.

Activity Table

Figure 5:
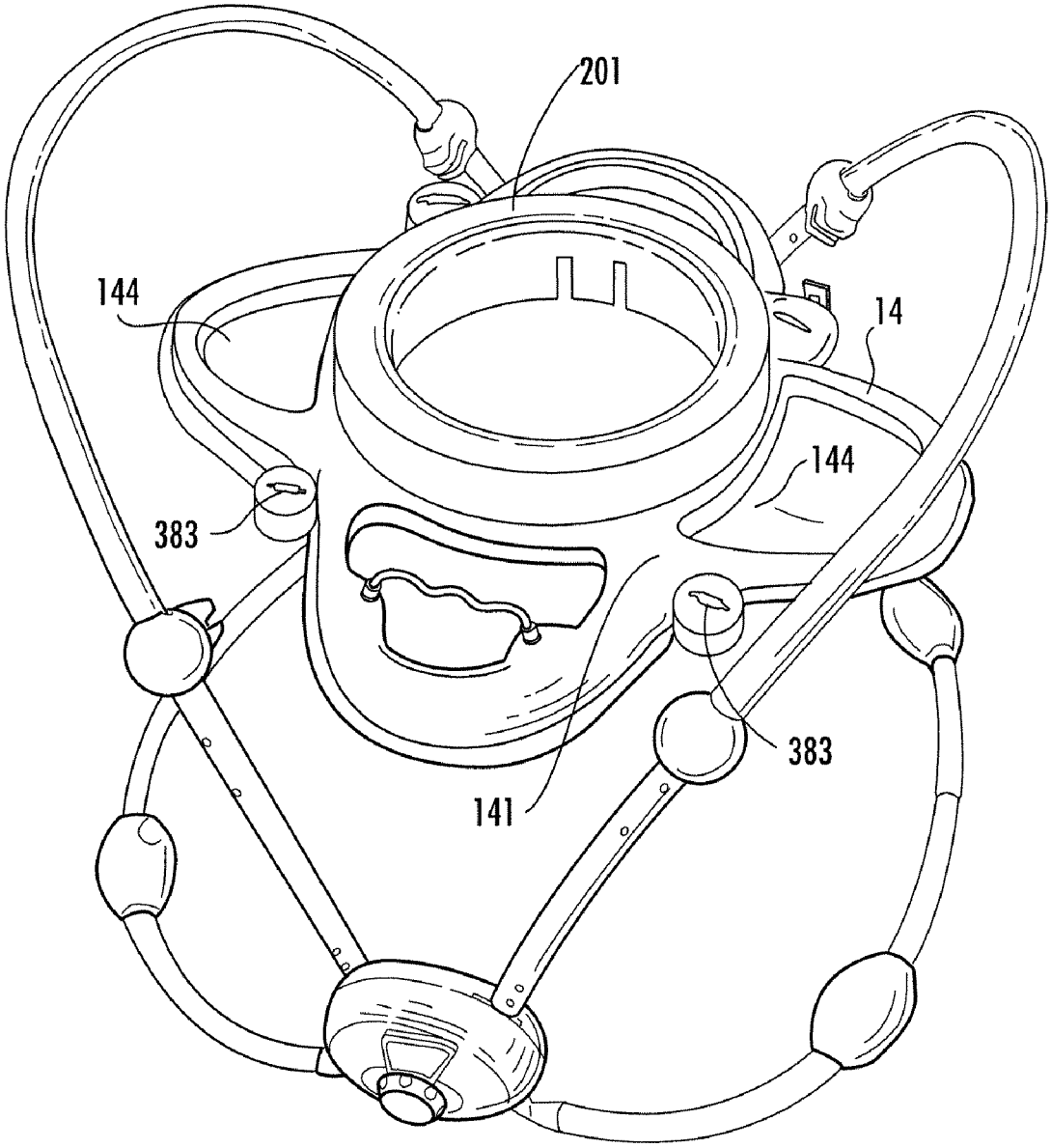
FIG. 5 shows a perspective view of a seat and activity table according to one embodiment of the invention.
Figure 6:
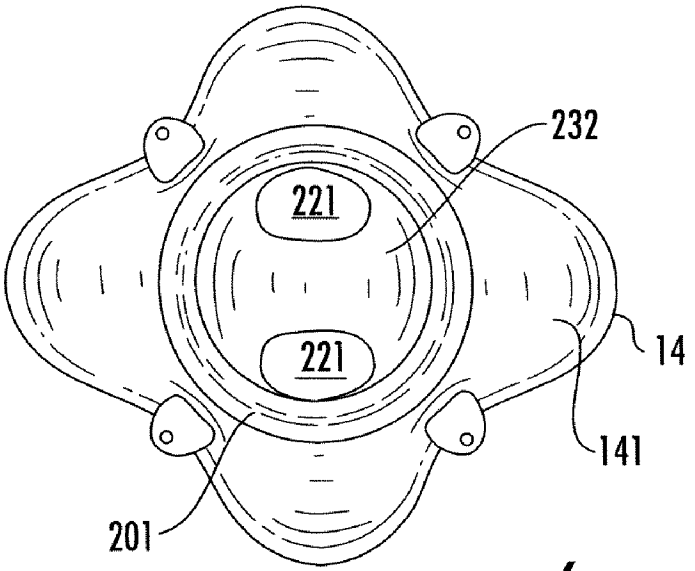
FIG. 6 shows a top view of the seat and activity table according to another embodiment of the invention.
Figure 7A:
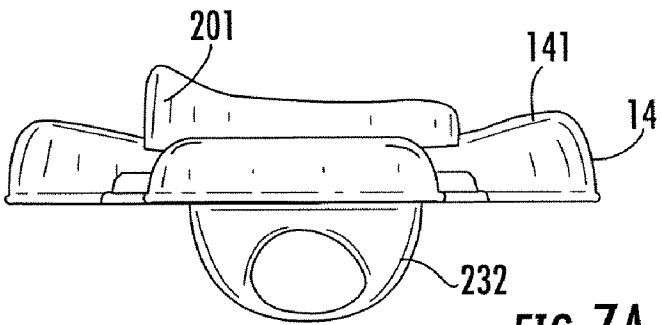
FIG. 7A shows a first side view of the seat and activity table in FIG. 6.
Figure 7B:
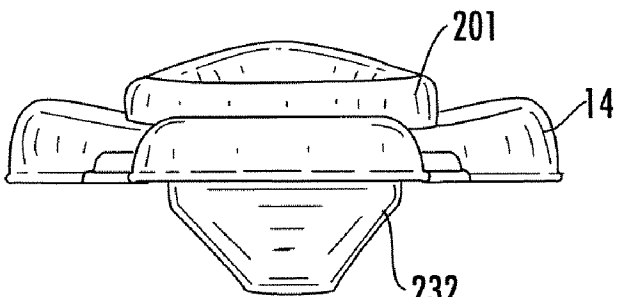
FIG. 7B shows a second side view of the seat and activity table in FIG. 6.

As mentioned above, the apparatus 10 may further include an activity table 14. FIGS. 1 through 3 and 5 illustrate various embodiments of activity tables 14, 44 that surrounds the seat 12, 42 of the exercise apparatus 10, 40 and includes an upper surface 141, 441 configured for receiving and supporting one or more children's activity items 142. As shown in FIGS. 3 and 5, the upper surface 141, 441 of the activity table 14 includes recessed receptacles 144, 444 that are dimensioned to receive activity items 142 that have engagement portions for mating with the recessed receptacles 144, 444. For example, the upper surface 141, 444 of each of the tables 14, 44 shown in FIGS. 3 and 5 includes four receptacles 144, 444.

In a further embodiment, each receptacle 144, 444 can be configured to receive a different type of activity item 142, such as an electronic piano, mechanical, or physically interactive toys, and a tray for holding food. A piano is a term used to describe a mechanical or electrical activity item that includes keys or buttons for the child to push, and in response to the child pushing the keys or buttons, music, voice, or other sounds are played. Mechanical toys can include bead-chasers, spring loaded toys that vibrate back and forth when pulled or pushed, toys mounted on an axis that spin when force is applied to the toy. Other activity items 142 that can be mounted to the table 14, 44 or onto the upper frame members 11*a*, 11*b* include bead chasers, flexible mirrors, see-saw clickers, and stalk toys, such as rattle balls, water or gel-filled teething toys, mirrors, and squeakers.

As mentioned above and shown in FIG. 7, one embodiment of the activity table 14 is integrally formed with the seat support ring 211. The outer wall 214 of the seat support ring 211 extends downwardly from the outer periphery of the annular horizontal engagement surface 212. The activity table 14 defines a horizontal annular groove 145 that has a central vertical axis C, which is coaxial with the central vertical axis B of the seat support ring 211, and includes a lower horizontal surface 146. The wall 214 of the seat support ring 211 intersects the lower horizontal surface 146, serving as an inner wall of the horizontal annular groove 145. The groove 145 is useful for containing any food or drink spills that may occur while a child is positioned within the exercise apparatus 10, which facilitates cleaning up the spills. In an alternative embodiment (not shown), the table 14 does not include a groove 145 and the wall 214 intersects with the upper surface 141 of the activity table 14.

In another alternative embodiment, the seat support ring 211 and the activity table 14 are separate. As shown in FIG. 8, an annular groove 147 is defined in the activity table 14 by an outer vertical wall 148 that extends downwardly from the upper surface 141 of the activity table 14, a horizontal surface 149 that extends horizontally towards a central vertical axis D of the groove, and an inner vertical wall 150 that extends upwardly from the horizontal surface 149 of the groove 147. The outer wall 214 of the seat support ring 211 extends downwardly from the annular horizontal engagement surface 212, and the inner diameter of the outer wall 214 is approximately the same as the outer diameter of the inner wall 150 of the annular groove 147. To couple the seat support ring 211 to the activity table 14, the outer wall 214 of the seat support ring 211 is positioned adjacent to the inner wall 150 of the groove 147 and the central vertical axis D of the groove 147 is coaxial with the central vertical axis B of the seat support ring 211.

CONCLUSION

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A children's exercise and activity apparatus for providing exercise functionality for a small child, said apparatus comprising:

one or more stationary hubs stably spaced apart from and above a support surface for the exercise and activity apparatus;

one or more upper frame members coupled adjacent to and extending upwardly and in two or more radially outward directions from said one or more stationary hubs, wherein said upper frame members substantially converge toward said stationary hubs;

a seat structured to support the child while allowing the child's legs to extend downwardly below the seat; and one or more resilient members extending between at least one of said upper frame members and said seat, said resilient members having a resiliency that is adapted for suspending the seat above a support surface and allowing the child to bounce relative to the support surface in response to a substantially vertical push.

2. The apparatus of claim 1 wherein said one or more upper frame members are arcuate-shaped.

3. The apparatus of claim 1 further comprising one or more base frame members extending downwardly and in a radially outward direction from at least one of said stationary hubs, wherein at least a portion of said one or more base frame members is adapted to engage said support surface.

4. The apparatus of claim 3 wherein said one or more base frame members and said one or more upper frame members are pivotably coupled to at least one of said stationary hubs, and wherein said one or more upper frame members and said one or more base frame members are adapted for pivoting about said at least one of said stationary hubs between an expanded position and a folded position.

5. The apparatus of claim 1 wherein said resilient members define an end, and wherein said seat is coupled directly to said end of at least one of said resilient members.

6. The apparatus of claim 1 wherein said resilient members define a first and second end and an intermediate portion extending between said first and second end, and wherein said seat is coupled directly to said intermediate portion of at least one of said resilient members.

7. The apparatus of claim 1 wherein said one or more upper frame members are pivotably coupled to at least one of said stationary hubs.

8. The apparatus of claim 1 wherein at least one of the resilient members comprises a helical tension spring.

9. The apparatus of claim 1 wherein said seat is adapted to rotate 360 degrees.

10. The apparatus of claim 1 wherein a distance between the seat and the support surface is adjustable by moving said one or more resilient members along said one or more upper frame members.

11. The apparatus of claim 10 wherein each of said one or more resilient members is coupled with each of said one or more upper frame members using a resilient member connector, said resilient member connector comprising:

a first portion and a second portion, each of said first portion and said second portion defining a first aperture extending therethrough, said first aperture having inner dimensions that are adapted for receiving each of said one or more upper frame members, wherein said first portion and said second portion are adapted for being removably secured adjacent to each other with an end portion of one of said resilient members secured therebetween.

12. The apparatus of claim 11 wherein said resilient member connector further comprises:

a keyhole shaped aperture, said keyhole shaped aperture comprising said first aperture and a second aperture, and wherein said second aperture has inner dimensions that are adapted for receiving one or more protrusions extending from each of said one or more upper frame members, and a guide surface extending from an outer surface of said resilient member connector toward said second aperture, said guide surface configured for seating adjacent one of said one or more protrusions.

13. A children's exercise and activity apparatus for providing exercise functionality for a small child, said apparatus comprising:

one or more stationary hubs stably spaced above a support surface for the exercise and activity apparatus;

first and second upper frame members, each of said upper frame members comprising first and second end portions and a middle portion extending between the first and second end portions;

first and second base frame members extending downwardly and in a radially outward direction from said stationary hubs, at least a portion of said base frame members adapted for engaging the support surface;

a seat structured to support the child while allowing the child's legs to extend downwardly below the seat; and one or more resilient members extending between said middle portion of at least one of said upper frame members and said seat, said resilient members having a resiliency that is adapted for suspending the seat above the support surface and allowing the child to bounce relative to the support surface in response to a substantially vertical push, wherein said first end portion of a first upper frame member and said first end portion of said second upper frame member are coupled to one of said one or more stationary hubs such that said first upper frame member and said second upper frame member extend upwardly and in a radially outward direction from said stationary hub unit.

14. The apparatus of claim 13 wherein said first upper frame member and said second upper frame member converge relative to each other toward at least one of said stationary hubs.

15. The apparatus of claim 13 wherein said first end portions of said first upper frame member and said second upper frame member are slightly curved and angled toward each other.

16. The apparatus of claim 13 wherein the upper frame members have a horizontal portion, a vertical portion, and a bend extending between the two portions.

17. The apparatus of claim 13 wherein one or more activity items are suspended from at least one of the upper frame members.

18. The apparatus of claim 13 wherein each of said base frame members comprises a first end portion and wherein each of said first end portions of said upper frame members and said base frame members are pivotably coupled to said one or more stationary hubs.

19. The apparatus of claim 18 wherein each of said one or more stationary hubs comprise a first guide plate and a second guide plate, said guide plates being spaced apart and adapted for receiving said first end portions of said upper frame members and said base frame members therebetween, each of said first and second guide plates defining:

a pair of pivot slots, each of said pivot slots adapted for receiving a pivot pin extending from each of said first end portions of said upper frame members, wherein each of said pivot slots defines a pivot point from each of said upper frame members;

a pair of first guide slots, each of said first guide slots being positioned below each of said pivot slots and extending generally in a direction that is generally parallel with said support surface, wherein each of said first guide slots are adapted for receiving a first guide pin extending from each of said first end portions of said upper frame members, said first guide pins further extending through an aperture defined in each of said first end portions of said base frame members, each of said first guide slots defining a range of motion for each of said upper frame members and each of said apertures defining a pivot point for each of said base frame members; and a pair of second guide slots, each of said second guide slots being positioned between each of said pivot slots and said first guide slots and extending generally in a direction that is generally perpendicular to said support surface, wherein each of said second guide slots are adapted for receiving a second guide pin extending from each of said first end portions of said base frame members, each of said second guide slots defining a range of motion for each of said base frame members.

20. The apparatus of claim 19 wherein each of said stationary hubs further comprise a locking mechanism for preventing movement of said upper frame members and said base frame members relative to each of said one or more stationary hubs, said locking mechanism comprising:

a locking plate defining one or more pairs of locking slots, each of said one or more pairs of locking slots comprising a first locking slot and a second locking slot, said first locking slot adapted for receiving one of said second guide pins when said apparatus is in an expanded position and said second locking slot adapted for receiving one of said second guide pins when said apparatus is in a folded position, wherein said locking plate is biased against said second guide plate such that each of said second guide pins are engaged in one of said first locking slot or said second locking slot when said apparatus is substantially in said expanded position or said folded position, respectively.

21. The apparatus of claim 20 wherein said locking mechanism further comprises:

a shaft defining a cavity and having first end and a second end, said first end being coupled to a knob and said second end being coupled to said locking plate;

a coupling pin having a first engagement surface and a second engagement surface, said coupling pin extending through said second guide plate and said locking plate, wherein said first engagement surface is adjacent said first guide plate and said second engagement surface is within said cavity of said shaft;

a helical compression spring extending between said locking plate and said second engagement portion of said coupling pin, wherein in response to pulling said knob outwardly from said second guide plate, said spring is engaged, said locking plate is moved outwardly from said second guide plate, said locking slots are disengaged from said second guide pins, and said locking plate is rotatable about said coupling pin.

22. A children's exercise apparatus for providing exercise functionality for a small child, said apparatus comprising:

a first and a second frame member, each of said first and second frame members comprising an upper frame member and a base frame member, said base frame member being adapted to engage a support surface;

said first and second frame members being pivotably connected to each other at a position between said upper frame members and said base frame members; said upper frame members and said base frame members forming an X-shape around the position where the first and second frame members are pivotably connected together;

a seat structured to support the child while allowing the child's legs to extend downwardly below the seat; and one or more resilient members extending between one of said upper frame members and said seat, said one or more resilient members having a resiliency that is adapted for suspending the seat above the support surface and allowing the child to bounce relative to the support surface in response to a substantially vertical push.

23. The apparatus of claim 22 wherein said upper frame member and said base frame member of said first frame member and said upper frame member and said base frame member of said second frame member are separately formed.

24. The apparatus of claim 23 wherein said apparatus further comprises one or more stationary hubs, each of said one or more stationary hubs being adapted for receiving an end of said upper frame member of said first frame member, an end of said upper frame member of said second frame member, an end of said base frame member of said first frame member, and an end of said base frame member of said second frame member.

25. The apparatus of claim 24 wherein each of said first and second frame members is pivotably coupled to said one or more stationary hubs.

26. The apparatus of claim 24 wherein said upper frame members and said base frame members of said first and second frame members are configured to pivot about said one or more stationary hubs upwardly toward each other.

27. The apparatus of claim 22 wherein each of said one or more resilient members includes a resilient portion and first, second, and third fabric portions, wherein said resilient portion and said third fabric portion extend between and are coupled to said first and second fabric portions, and wherein said resilient member has a resilient extension length range that is less than a length of said third fabric portion.

* * * * *

UNITED STATES PATENT AND TRADEMARK OFFICE

CERTIFICATE OF CORRECTION

PATENT NO. : 7,614,979 B2
APPLICATION NO. : 11/396408
DATED : November 10, 2009
INVENTOR(S) : Thomson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 894 days.

Signed and Sealed this

Nineteenth Day of October, 2010

David J. Kappos

David J. Kappos
*Director of the United States Patent and Trademark Office*